US011560296B2

(12) United States Patent
Zaharie et al.

(10) Patent No.: US 11,560,296 B2
(45) Date of Patent: Jan. 24, 2023

(54) EXPANDABLE LIFT

(71) Applicant: Alpha Services, LLC, Coeur d' Alene, ID (US)

(72) Inventors: Robert Wade Zaharie, Post Falls, ID (US); Javier Cervantes, Hickory, MS (US)

(73) Assignee: Alpha Services, LLC, Coeur d' Alene (ID)

( * ) Notice: Subject to any disclaimer, the term of this patent is extended or adjusted under 35 U.S.C. 154(b) by 0 days.

(21) Appl. No.: 16/991,516

(22) Filed: Aug. 12, 2020

(65) Prior Publication Data

US 2022/0048744 A1 Feb. 17, 2022

(51) Int. Cl.
*B66F 7/14* (2006.01)

(52) U.S. Cl.
CPC ..... *B66F 7/14* (2013.01)

(58) Field of Classification Search
CPC .... B66F 7/14; B66F 7/025; B66F 7/28; B66F 7/10; B66F 7/12
See application file for complete search history.

(56) References Cited

U.S. PATENT DOCUMENTS

| | | | | |
|---|---|---|---|---|
| 1,927,598 | A * | 9/1933 | Schlichter | B66F 7/14 254/7 R |
| 5,702,222 | A * | 12/1997 | Rosen | B66F 7/025 187/214 |
| 6,416,069 | B1 * | 7/2002 | Ramsey | B60G 11/27 280/124.116 |
| 7,712,583 | B2 * | 5/2010 | Matsumoto | B66F 7/20 187/250 |
| 10,745,259 | B2 * | 8/2020 | Kritzer | E04H 6/06 |
| 2011/0094830 | A1 * | 4/2011 | Lund | B66F 3/46 187/203 |
| 2019/0389704 | A1 * | 12/2019 | Knapp | B66F 1/06 |

* cited by examiner

*Primary Examiner* — Seahee Hong
(74) *Attorney, Agent, or Firm* — Lee & Hayes, P.C.

(57) ABSTRACT

An expandable lift system includes an expandable platform including at least one detachable panel to expand a dimension of the expandable platform. At least one stationary stanchion houses a first lifting assembly. The first lifting assembly is coupled to a first side of the expandable platform. At least one translatable stanchion houses a second lifting assembly, and the second lifting assembly is coupled to a second side of the platform. At least one track is coupled to a substructure on which the lift sits. The track includes a rail defined within the at least one track. The at least one translatable stanchion is configured to translatably engage the rail to allow the at least one translatable stanchion to move laterally in a first direction. At least one stop is located at at least one end of the track to retain engagement of the translatable stanchion within the rail.

20 Claims, 18 Drawing Sheets

EXPANDABLE LIFT

TECHNICAL FIELD

The present disclosure relates to a lift apparatus, system, and method, and more particularly, to an expandable, electrically-driven lift.

BACKGROUND

Lift apparatuses are used to raise objects such as vehicles, off-highway vehicles (OHVs), side-by-side vehicles, utility terrain vehicles (UTVs), recreational off-highway vehicles (ROVs), four-wheel off-highway vehicles, golf carts, and motorcycles, among a myriad of other objects and vehicles, vertically from a lower position such as at ground level to a higher position. A lift apparatus includes a platform formed to accommodate the object. Further, the lift apparatus may be raised to a desired height in order to allow the object to be removed from the space on a surface of, for example, a garage, to allow another object or objects to be placed thereunder. For example, an OHV may be raised using the lift apparatus, and a second object like another OHV, a motorcycle, or a car may be parked underneath the platform of the lift apparatus. This allows for the two objects to be vertically stored within, for example, the garage while occupying half the floor space within the garage otherwise. Further, the lift apparatus may be used to vertically elevate the object to allow a user to access an underside of the object. For example, a motorcycle may be hoisted vertically on the lift apparatus to allow the user to access portions of the underside of the motorcycle for maintenance purposes. Some homeowners and apartment dwellers may desire to conserve space within their private garages and/or service vehicles therein. However, large lift apparatuses used by, for example vehicle maintenance shops may take up large amounts of space within the garage given the bulkiness of these types of lift apparatuses.

Examples of the present disclosure are directed at least in part toward overcoming the deficiencies described above.

SUMMARY

As described above, the lift apparatus may be used to raise objects a user may find difficult to lift under their own physical power. As described above, the lift apparatus may be used to lift vehicles of various kinds to allow the user to perform maintenance on the vehicles. Further, the lift apparatus described herein may also be used as a variable-height workbench. The lift apparatus may be utilized as a variable-height workbench by placing an object on the lift apparatus and causing the lift to be raised to a desired height whether at a sitting height or a standing height of the user.

In some examples, the lift apparatus may be referred to as a "stacker." A stacker may serve to allow a user such as a car collector to double storage capacity of a specific area. In this example, a first vehicle may be placed on the platform of the lift apparatus to raise the first vehicle to a desired height. A second vehicle may then be parked or stored below the first vehicle in the empty space below the platform of the stacker. In this manner, the user may utilize vertical space above the stacker to their benefit in effectively managing and conserving floor space within an area such as a garage. Thus, as used in the present specification and in the appended claims, the terms "lift system," "expandable lift system," "lift apparatus," "stacker," and similar language is meant to be understood broadly as any device capable of hoisting or lifting an object from a first vertical position to at least a second vertical position.

In an example of the present disclosure, a system includes a platform. The platform includes a first portion, and a second portion expandable relative to the first portion. The system also includes a first lifting assembly disposed within a first stationary stanchion. The first lifting assembly includes a first threaded screw rotatably disposed within the first stationary stanchion, and a first body disposed within the first stationary stanchion, threadingly coupled to the first threaded screw, and coupled to a first corner of the platform located on the first portion. The system also includes a second lifting assembly disposed within a second stationary stanchion. The second lifting assembly includes a second threaded screw rotatably disposed within the second stationary stanchion, and a second body disposed within the second stationary stanchion, threadingly coupled to the second threaded screw, and coupled to a second corner of the platform located on the first portion. The system also includes a third lifting assembly disposed within a first translatable stanchion. The third lifting assembly includes a third threaded screw rotatably disposed within the first translatable stanchion, and a third body disposed within the first translatable stanchion, threadingly coupled to the third threaded screw, and coupled to a third corner of the platform located on the second portion. The system also includes a fourth lifting assembly disposed within a second translatable stanchion. The fourth lifting assembly includes a fourth threaded screw rotatably disposed within the second translatable stanchion, and a fourth body disposed within the second translatable stanchion, threadingly coupled to the fourth threaded screw, and coupled to a fourth corner of the platform located on the second portion. The system also includes a first track coupled to the first translatable stanchion, the first translatable stanchion translatably engaged with the first track to allow the first translatable stanchion to move laterally in a first direction. The system also includes a second track coupled to the second translatable stanchion, the second translatable stanchion translatably engaged with the second track to allow the second translatable stanchion to move laterally in the first direction. The second portion of the platform expands relative to the first portion in the first direction when the first translatable stanchion and the second translatable stanchion move in the first direction.

In another example of the present disclosure, a lift includes a platform. The platform includes a first portion, and a second portion expandable relative to the first portion. A first screw jack is coupled to a first corner of the platform located on the first portion. A second screw jack is coupled to a second corner of the platform located on the first portion. A third screw jack is coupled to a third corner of the platform located on the second portion. A fourth screw jack is coupled to a fourth corner of the platform located on the second portion. A first motor is coupled to the first screw jack. The first motor rotates the first screw jack. A second motor is coupled to the second screw jack. The second motor rotates the second screw jack. A third motor is coupled to the third screw jack. The third motor rotates the third screw jack. A fourth motor is coupled to the fourth screw jack. The fourth motor rotates the fourth screw jack. The lift also includes a control system to control activation of the first motor, the second motor, the third motor, and the fourth motor. The control system includes a user interface to control vertical translation of the platform based on activation of the first motor, the second motor, the third motor, and the fourth motor. The control system also includes control logic communicatively coupled to the user interface to perform operations including activating the first motor, the second motor, the third motor, and the fourth motor to vertically translate the platform based on user-input at the user interface. The control logic synchronizes the first motor, the second motor, the third motor, and the fourth motor to cause the first screw jack, the second screw jack, the third screw jack, and the fourth screw jack to rotate at a same rate.

In yet another example of the present disclosure, an expandable lift system, includes an expandable platform including at least one detachable panel to expand a dimension of the expandable platform. The expandable lift system also includes at least one stationary stanchion housing a first lifting assembly. The first lifting assembly is coupled to a first side of the expandable platform. At least one translatable stanchion housing a second lifting assembly is also included in the expandable lift system. The second lifting assembly is coupled to a second side of the platform. The expandable lift system also includes at least one track coupled to a substructure on which the lift sits. The track includes a rail defined within the at least one track. The at least one translatable stanchion is configured to translatably engage the rail to allow the at least one translatable stanchion to move laterally in a first direction. At least one stop is located at at least one end of the track to retain engagement of the at least one translatable stanchion within the rail.

DETAILED DESCRIPTION

The lift apparatuses and systems described herein provide a compact drive mechanism for operating the lift apparatus. The lift apparatus may be electrically driven. The lift apparatus includes a platform non-rotatably mounted to a plurality of screw jacks so that the platform may translate the length of the screws and correspondingly be raised or lowered. Further, the lift apparatus may include at least two, and, in some examples, four lifting assemblies for supporting a platform. At least one of the lift apparatus is translatably engaged with a track to allow the lift apparatus to move laterally in a first direction, and widen the lift system to accommodate various sizes of objects hoisted onto the lift system and provide for the conservation of space within the area in which the lift system is installed and/or operated. A number of panels associated with the platform may be selectively removed and coupled to the platform as the lift apparatus is translated to make the platform narrower or wider.

The lifting assemblies are formed to translate along the length of the screws and may be driven by an electric motor at substantially the same rate and in the same rotational direction. The electrical motors may be synchronized to drive the screws at the same rate using an electronic device that causes the electrical motors to operate at the same or substantially the same rotations per minute (rpm) to ensure that the platform to which the screws are coupled to remains level in two coordinate directions and along a common plane.

Figure 1:
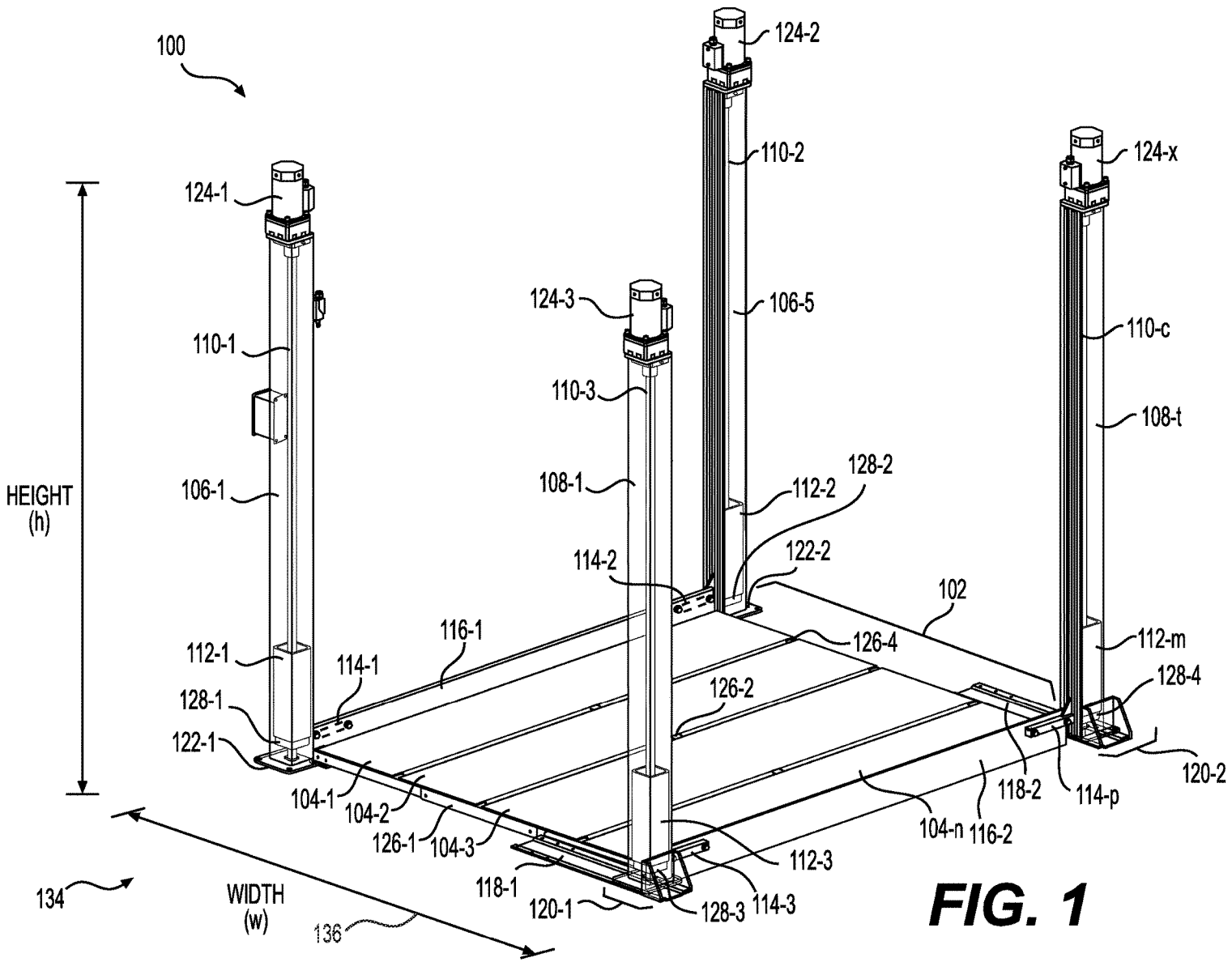
FIG. 1 is a schematic of an expandable lift system, according to an example of the principles described herein.

Wherever possible, the same reference numbers will be used throughout the drawings to refer to the same or like parts. Referring to FIG. 1, FIG. 1 is a schematic of an expandable lift system 100, according to an example of the principles described herein. The expandable lift system 100 may be installed in an area with a relatively smaller footprint as compared to other lift systems due to the expandable features of the expandable lift system 100 described herein. Therefore, the expandable lift system 100 may be installed within, for example, a residential garage or shop, a relatively smaller vehicle repair shop and similar locations and in similar scenarios where space may be limited and/or where capabilities of a lift system may be desired without a loss in additional floor-based storage space.

The expandable lift system 100 may include a platform 102 on which vehicles and other objects may be seated. The platform 102 may include a plurality of panels 104-1, 104-2, 104-3, **104-*n*, where n is any integer greater than or equal to 1 (collectively referred to herein as panel(s) 104 unless specifically addressed otherwise). For example, the panels 104 may include a first panel 104-1, a second panel 104-2, a third panel 104-3, and a fourth panel 104-*n* within the platform 102. Although four panels 104 are depicted in FIG. 1, any number of panels may be added to or removed from the platform 102 as needed to accommodate the width of the platform 102**.

In an example, at least one of the panels 104 may be selectively removed and replaced as the width (w) of the expandable lift system 100 is decreased or increased to fit a particular application. For example, with one or more of the panels 104 removed, a motorcycle or a utility terrain vehicle (UTV) may be hoisted up by the expandable lift system 100. In an example, the addition of one or more panels 104 into the platform 102 increases the width of the platform 102 (e.g., the extension of the platform 102). Thus, using the addition of the panel(s) 104 allows for larger vehicles like small, mid-sized, and large automobiles to be hoisted by the expandable lift system 100. In this manner, the expandable lift system 100 may accommodate a myriad of differently sized objects making the expandable lift system 100 versatile and creating a more utilitarian lift system for a user. In an example, the first panel 104-1 and the fourth panel **104-*n* may be affixed to the platform 102 while the second panel 104-2 and the third panel 104-3** may be removable.

The expandable lift system 100 may include a plurality of stationary stanchions 106-1, **106-*s*, where s is any integer greater than or equal to 1 (collectively referred to herein as stationary stanchion(s) 106 unless specifically addressed otherwise). For example, the stationary stanchions 106 may include a first stationary stanchion 106-1 and a second stationary stanchion 106-*s* included within the expandable lift system 100. In an example, the expandable lift system 100 may include one or more stationary stanchions 106**.

The expandable lift system 100 may include a plurality of translatable stanchions 108-1, **108-*t*, where t is any integer greater than or equal to 1 (collectively referred to herein as translatable stanchion(s) 108 unless specifically addressed otherwise). For example, the translatable stanchions 108 may include a first translatable stanchion 108-1 and a second translatable stanchion 108-*t* included with the expandable lift system 100. In an example, the expandable lift system 100 may include one or more translatable stanchions 108**.

In an example where the expandable lift system 100 includes one or more stationary stanchions 106 and one or more translatable stanchions 108, the expandable lift system 100 may include one stationary stanchion 106 and one translatable stanchion 108. The one stationary stanchion 106 and one translatable stanchion 108 may include, for example, a stationary stanchion 106 and a translatable stanchion 108 located on a same side of the expandable lift system 100 along the width (w) of the expandable lift system 100. Thus, either the first stationary stanchion 106-1 and the first translatable stanchion 108-1 or the second stationary stanchion **106-*s* and the second translatable stanchion 108-*t* may be included in the expandable lift system 100. This allows for the stationary stanchion 106 and the translatable stanchion 108 located on a same side of the expandable lift system 100 to support the weight of the object being hoisted by the expandable lift system 100 in a manner that provides stability in lifting the object. Although two stanchions 106, 108 are described here. In an example, the description herein provides for four stanchions 106, 108 including two stationary stanchions 106 and two translatable stanchions 108 to hoist the platform 102 and an object on the platform 102**.

Each stanchion includes a jack mount 112-1, 112-2, 112-3, **112-*m*, where m is any integer greater than or equal to 1 (collectively referred to herein as jack mount(s) 112 unless specifically addressed otherwise). For example, the jack mounts 112 may include a first jack mount 112-1, a second jack mount 112-2, a third jack mount 112-3, and a fourth jack mount 112-*m* within the stanchions 106, 108. The jack mounts 112 may be disposed within an interior portion of the stanchions 106, 108. The jack mounts 112 may be disposed within the stanchions 106, 108 such that the exterior surfaces of the walls of the jack mounts 112 have approximately the same dimensions of the interior surfaces of the walls of the stanchions 106, 108. This allows the jack mounts 112 to move within the stanchions 106, 108 in a vertical direction along the same axis of a longitudinal axis of the stanchions 106, 108 without binding within the stanchions 106, 108. The engineering fit between the exterior surfaces of the walls of the jack mounts 112 and the interior surfaces of the walls of the stanchions 106, 108 may include a clearance fit, a transition fit, or an interference fit according to the International Organization for Standardization (ISO) standards of engineering fits. A clearance fit may include any fit where the interior surfaces of the walls of the stanchions 106, 108 are larger than the exterior surfaces of the walls of the jack mounts 112 to allow the two parts to slide relative to one another when assembled. A transition fit may include any fit where the interior surfaces of the walls of the stanchions 106, 108 are fractionally smaller or larger than the exterior surfaces of the walls of the jack mounts 112 to where mild force is required to move the jack mounts 112 with respect to the stanchions 106, 108. An interference fit may include any fit where the interior surfaces of the walls of the stanchions 106, 108 are smaller than the exterior surfaces of the walls of the jack mounts 112 to where high force is required to move the jack mounts 112 with respect to the stanchions 106, 108. In an example, the engineering fit between the jack mounts 112 and the stanchions 106, 108** may include an ISO standardize engineering fit between an H11/c11 loose running fit of a clearance fit and an H7/n6 fixed fit of a transition fit.

The platform 102 may include a first side rail 116-1 and a second side rail 116-2. The first side rail 116-1 may extend between the first stationary stanchion 106-1 and the second stationary stanchion **106-*s*. The second side rail 116-2 may extend between the first translatable stanchion 108-1 and the second translatable stanchion 108-*t*. The side rails 116-1, 116-2 may be coupled to a substructure of the platform 102 including at least two supports 126-1, 126-2, 126-*u*, where u is any integer greater than or equal to 1 (collectively referred to herein as support(s) 126 unless specifically addressed otherwise). The supports 126 support and hold the panels 104 in place as well as provide support for the objects placed on the platform 102. In an example, the first side rail 116-1 and the second side rail 116-2 may include vertical and horizontal portions that form a perpendicular angle relative to one another such that the first side rail 116-1 and the second side rail 116-2 have an L-shaped cross section. The supports 126 may sit on the horizontal portions of the L-shaped cross sections of the first side rail 116-1 and the second side rail 116-2. More details regarding the platform 102, the supports 126, and the first side rail 116-1 and the second side rail 116-2** are provided herein.

The jack mounts 112 may be coupled to the platform 102 at the first side rail 116-1 and the second side rail 116-2 via a corresponding number of platform mounts 114-1, 114-2, 114-3, **114-*p*, where p is any integer greater than or equal to 1 (collectively referred to herein as platform mount(s) 114 unless specifically addressed otherwise). For example, the platform mounts 114 may include a first platform mount 114-1, a second platform mount 114-2, a third platform mount 114-3, and a fourth platform mount 114-*p* coupled to a respective one of the side rails 116-1, 116-2 of the platform 102. Further, the platform mounts 114 may be coupled to a respective one of the jack mounts 112. In an example, the platform mounts 114 may be coupled to the respective one of the jack mounts 112 by monolithically forming the platform mounts 114 with the jack mounts 112, by welding the platform mounts 114 to the jack mounts 112, or by fastening the platform mounts 114 to the jack mounts 112** via a fastener.

Each of the platform mounts 114 may include a jack mount base 128-1, 128-2, 128-3, 128-4, collectively referred to herein as jack mount base(s) 128 unless specifically addressed otherwise. The jack mount bases 128 may include a threaded aperture 132-1, 132-2, 132-3, 132-4 defined therein through which a screw drive 110-1, 110-2, 110-3, **110-*d* used in hoisting the platform 102 may threadingly engage with the threaded apertures 132. The threaded apertures 132 may be collectively referred to herein as threaded apertures(s) 132 unless specifically addressed otherwise. The designation d is any integer greater than or equal to 1, and the screw drives may be collectively referred to herein as screw drive(s) 110 unless specifically addressed otherwise. In this manner, the platform mounts 114 threadingly coupled the jack mounts 112 to a respective screw drive 110 via the threaded apertures 132 threadingly engaging with the screw drives 110 and the platform mounts 114 being mechanically coupled to the jack mounts 112. In an example, the jack mount bases 128 may be coupled to the respective jack mounts 112 through welding, the use of an ISO standard interference fit as described herein, the use of fasteners and/or other methods of coupling the jack mount bases 128 to the jack mounts 112**.

In an example, the jack mounts 112 may seat onto a respective platform mount 114 by being supported by an arm 130-1, 130-2, 130-3, 130-4 formed on each platform mount 114 and extending from the jack mount 112 and/or the jack mount bases 128. The arms 130 may be collectively referred to herein as arm(s) 130 unless specifically addressed otherwise. The arms 130 may extend away from the respective jack mount 112 and/or jack mount bases 128 in a direction toward the side rail 116 associated with the stanchion 106, 108. Thus, a first arm 130-1 and a second arm 130-2 may extend toward the first side rail 116-1, and a third arm 130-3 and the fourth arm 130-4 may extend toward the second side rail 116-2. The arms 130 of the platform mount 114 may be coupled to the side rails 116-1, 116-2 through monolithic forming, welding, or through the use of fasteners as described herein. In this manner, the coupling of the side rails 116 to the stanchions 106 via the platform mounts 114 allows for the platform 102 to mechanically engage with the stanchions 106, 108.

Each of the stationary stanchions 106 includes a base 122-1, 122-2, collectively referred to herein as bases 122 unless specifically addressed otherwise. The bases 122 may have a larger parameter relative to a parameter of the stationary stanchions 106 in order to provide stability to the stationary stanchions 106. The bases 122 may be coupled to the stationary stanchions 106 through monolithic forming, welding, or through the use of fasteners as described herein. Further, the bases 122 may include a number of fastening apertures to allow the bases 122 and the stationary stanchions 106 to be coupled to a substructure 134 on which the expandable lift system 100 sits. In an example, a number of anchors (not shown) may be used to couple the bases 122 to the substructure 134. The anchors may include adhesives, concrete screws, other forms of anchors, and combinations thereof. In this manner, the expandable lift system 100 may be secured to the substructure 134.

Further, the translatable stanchions 108 include a first base portion 120-1 and a second base portion 120-2 of the first translatable stanchion 108-1 and the second translatable stanchion 108-2, respectively. The base portions 120-1, 120-2 include elements that assist in the translating movement of the translatable stanchions 108. More details regarding the elements of the first base portion 120-1 and a second base portion 120-2 is described in more detail herein.

The expandable lift system 100 also includes a first track 118-1 and a second track 118-2 associated with the translatable stanchions 108. The first track 118-1 and the second track 118-2 are collectively referred to herein as track(s) 118 unless specifically addressed otherwise. The translatable stanchions 108 are translatingly engaged with the tracks such that the translatable stanchions 108 may be pulled or pushed along the tracks 118 in the directions of arrow 136 to expand or contract the width (w) of the expandable lift system 100. In the examples described herein, as the translatable stanchions 108 are moved along the tracks 118, the panels 104 of the platform 102 may be added or removed to increase or decrease the surface size of the platform 102. For example, in instances where the user seeks to decrease the width (w) of the expandable lift system 100, one or more panels 104 may be removed from the platform 102 to allow the translatable stanchions 108 to be moved along the tracks 118 toward the stationary stanchions 106. Conversely, in instances where the user seeks to increase the width (w) of the expandable lift system 100, one or more panels may be coupled to the platform 102 in order to provide a platform 102 having a larger surface area. In this manner, the tracks 118 and the translatable stanchions 108 provide for vehicles and other objects of varying sizes to be hoisted onto the expandable lift system 100.

Further, in instances where the expandable lift system 100 is not being used, the user may contract the width (w) of the platform 102 to allow for more area next to the expandable lift system 100 to be used for other purposes such as parking a vehicle. The tracks 118 are engineered to be strong enough and are shaped and have a profile low enough to allow vehicles to run over the tracks 118 without damaging the tracks 118 or the vehicle. In this manner, the utility of the expandable lift system 100 may be installed while still allowing for a conservation of a space in which the expandable lift system 100 is installed. This may prove to be effective in situations where the user has installed the expandable lift system 100 in a personal and/or residential garage or other location where space may be limited or may require versatility. The interface between the tracks 118 and the translatable stanchions 108 are described in more detail herein.

The expandable lift system 100 further includes a plurality of motors 124-1, 124-2, 124-3, **124-*x*, where x is any integer greater than or equal to 1 (collectively referred to herein as motor(s) 124 unless specifically addressed otherwise). For example, the expandable lift system 100 may include a first motor 124-1, a second motor 124-2, a third motor 124-3, and a fourth motor 124-*x* coupled to the stanchions 106, 108. Although the motors 124 are depicted in FIG. 1 as being coupled to a top portion of each of the stanchions 106, 108, the motors 124 may be coupled to any portion of the stanchions 106, 108 where the electrical energy produced by the motors 124 may be converted into mechanical energy used to hoist the platform 102 of the expandable lift system 100**.

In one example, the motors 124 may be stepper motors. In this example, the stepper motors 124 may be any brushless direct current (DC) electric motor that divides a full rotation into a number of equal steps. The position of the stepper motor may then be commanded to move and hold at one of these steps without any position sensor for feedback (e.g., via an open-loop controller), as long as the motor is sized to the application in respect to torque and speed. In this example, each motor 124 may include an encoder to realize a closed-loop feedback control and avoid a loss caused by step loss of stepper motor. The encoders may include a rotary encoder, an optical encoder, or other form of encoder. In one example, the stepper motor that includes an encoder may be accepted by a control system such as the control interface 1002 of FIG. 10 described herein. In one example, the stepper motor may include a closed-loop stepper motor where the closed loop stepper motor is accepted by a stepper motor driver. In one example, the stepper motors 124 are communicatively coupled to a pulse train or a microprocessor to allow the pulse train or microprocessor to operate stepper motors 124. The shafts of the stepper motors rotate in discrete step increments when electrical command pulses are applied to it in a proper sequence. The rotation of the stepper motors may have several direct relationships to these applied input pulses. For example, the sequence of the applied pulses is directly related to the direction of motor shaft's rotation. Further, the speed of the motor shaft rotation is directly related to the frequency of the input pulses, and the length of rotation is directly related to the number of input pulses applied. Any circuitry may be used to operate the motors 124 including, for example, a circuit that includes a motor and encoder in series, with each motor/encoder series in parallel with one another to control the motors via a switch such as the control interface 1002 and or the position sensor 1008 of FIG. 10.

Figure 2:
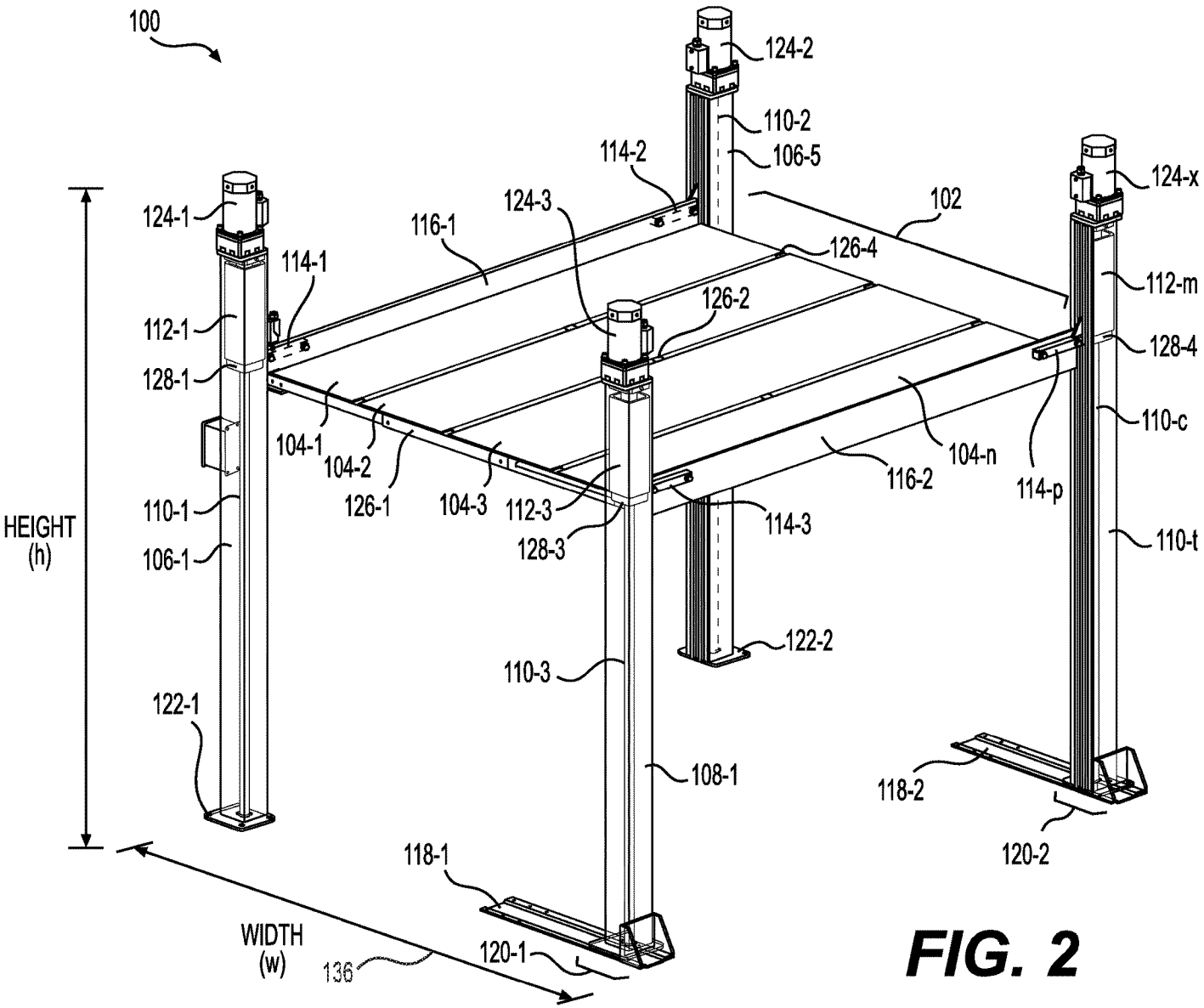
FIG. 2 is a schematic of the expandable lift system of FIG. 1 in a hoisted position, according to an example of the principles described herein.

FIG. 2 is a schematic of the expandable lift system 100 of FIG. 1 in a hoisted position, according to an example of the principles described herein. In an example, the motors 124 may be any electric motor that produces mechanical force by the interactions of an electric current and a magnetic field. However, the motors 124 may be any device that produces suitable mechanical force from any source of energy such as energy from chemical reactions, hydraulic forces, and pneumatic forces, among others. The motors 124 may directly or indirectly engage with respective screw drives 110 within the stanchions 106, 108 to cause the screw drives 110 to rotate about their longitudinal axis. Rotation of the screw drives 110 causes the platform 102 to be translated up or down based on the direction of rotation of a rotor shaft (not shown) of the motor 124. Thus, through activation of the motors 124, the platform 102 may be raised in order to hoist objects.

Figure 3:
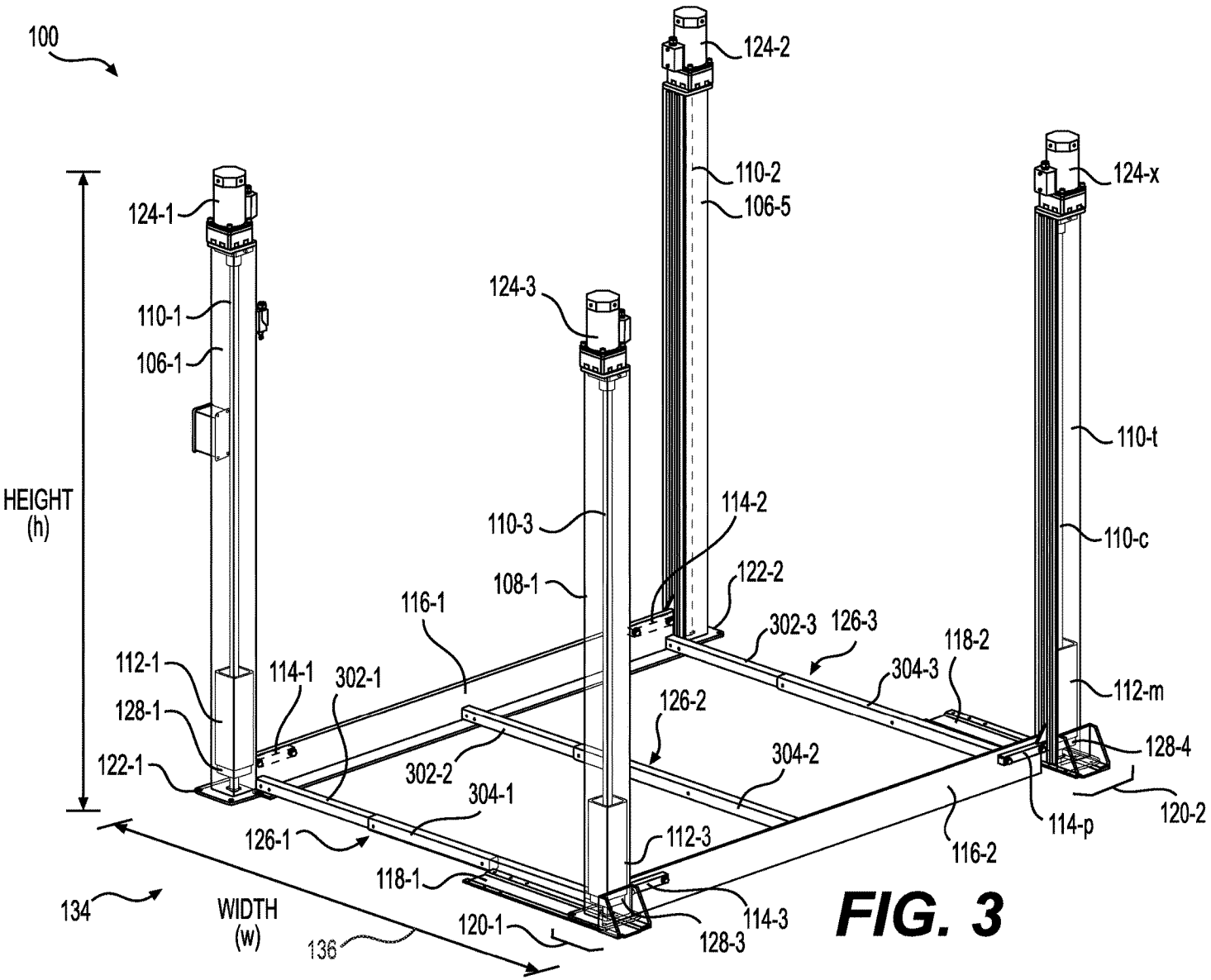
FIG. 3 is a schematic of the expandable lift system of FIG. 1 depicting supports of the expandable lift system, according to an example of the principles described herein.

FIG. 3 is a schematic of the expandable lift system 100 of FIG. 1 depicting supports 126 of the expandable lift system 100, according to an example of the principles described herein. The supports 126 span between and are coupled to the first side rail 116-1 and a second side rail 116-2 to serve as support for the panels 104 coupled to the platform 102. In order to accommodate any number of panels 104 within the platform 102, the supports may be telescopic such that each of the supports 126 include at least two parts that slide one within another. The telescopic function of the supports 126 allow for the supports 126 to be extended or shortened as the width (w) of the platform 102 is expanded or contracted. In an example, each support 126 may include a first portion, 302-1, 302-2, 302-3, collectively referred to herein as first portion(s) 302 unless specifically addressed otherwise. Further, each support 126 may include a second portion, 304-1, 304-2, 304-3, collectively referred to herein as second portion(s) 304 unless specifically addressed otherwise. The first portions 302 are dimensioned to fit inside and slide within the second portions 304. In this manner, as the expandable lift system 100 is expanded or contracted to allow for more or fewer panels 104 to be coupled to the platform 102 to accommodate different sizes of objects hoisted by the expandable lift system 100. Although two telescoping portions of the supports 126 (e.g., the first portions 302 and the second portions 304) are depicted and described herein, any plurality of separate portions. Further, in an example, the movement of the telescoping function of the supports 126 may be achieved by via a hydraulic system, a pneumatic system, an electric motor system, a pulley system, or other movement systems that may assist the user in expanding and/or contracting the supports 126 to adjust the width (w) of the platform 102.

Figure 4:
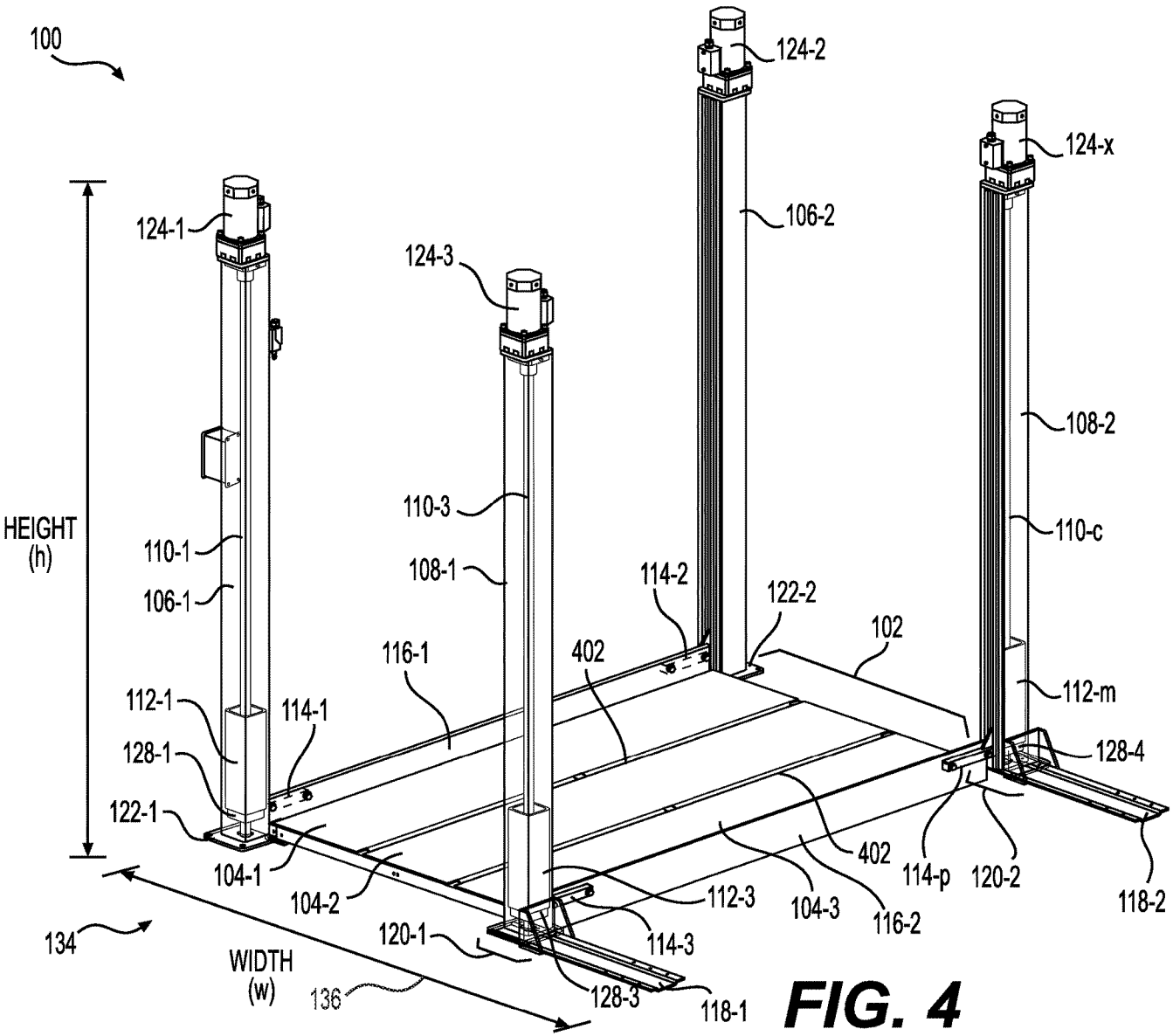
FIG. 4 is a schematic of the expandable lift system of FIG. 1 depicting the expandable lift system in a contracted state, according to an example of the principles described herein.
Figure 5:
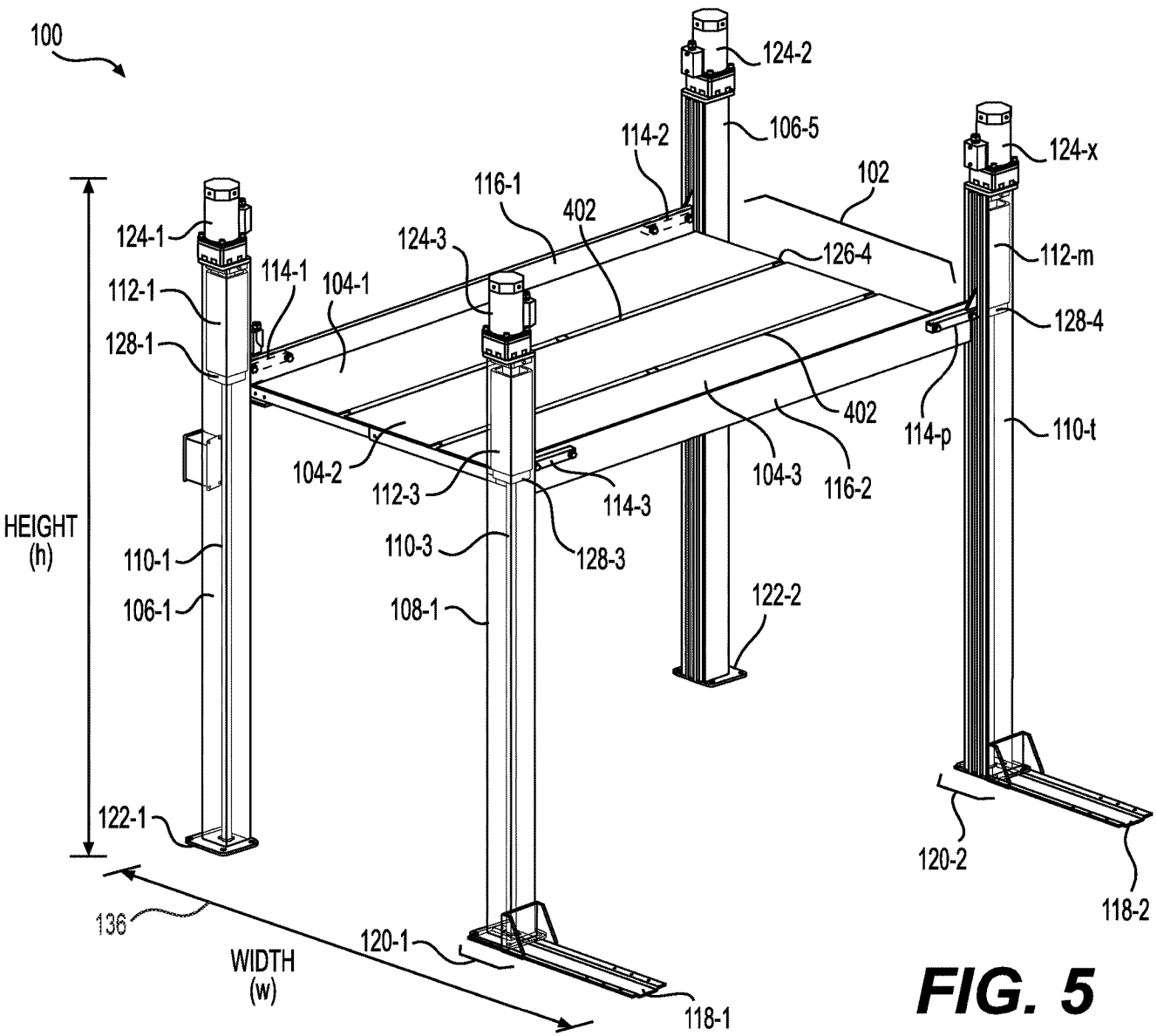
FIG. 5 is a schematic of the expandable lift system of FIG. 1 depicting the expandable lift system in hoisted position and a contracted state, according to an example of the principles described herein.
Figure 6:
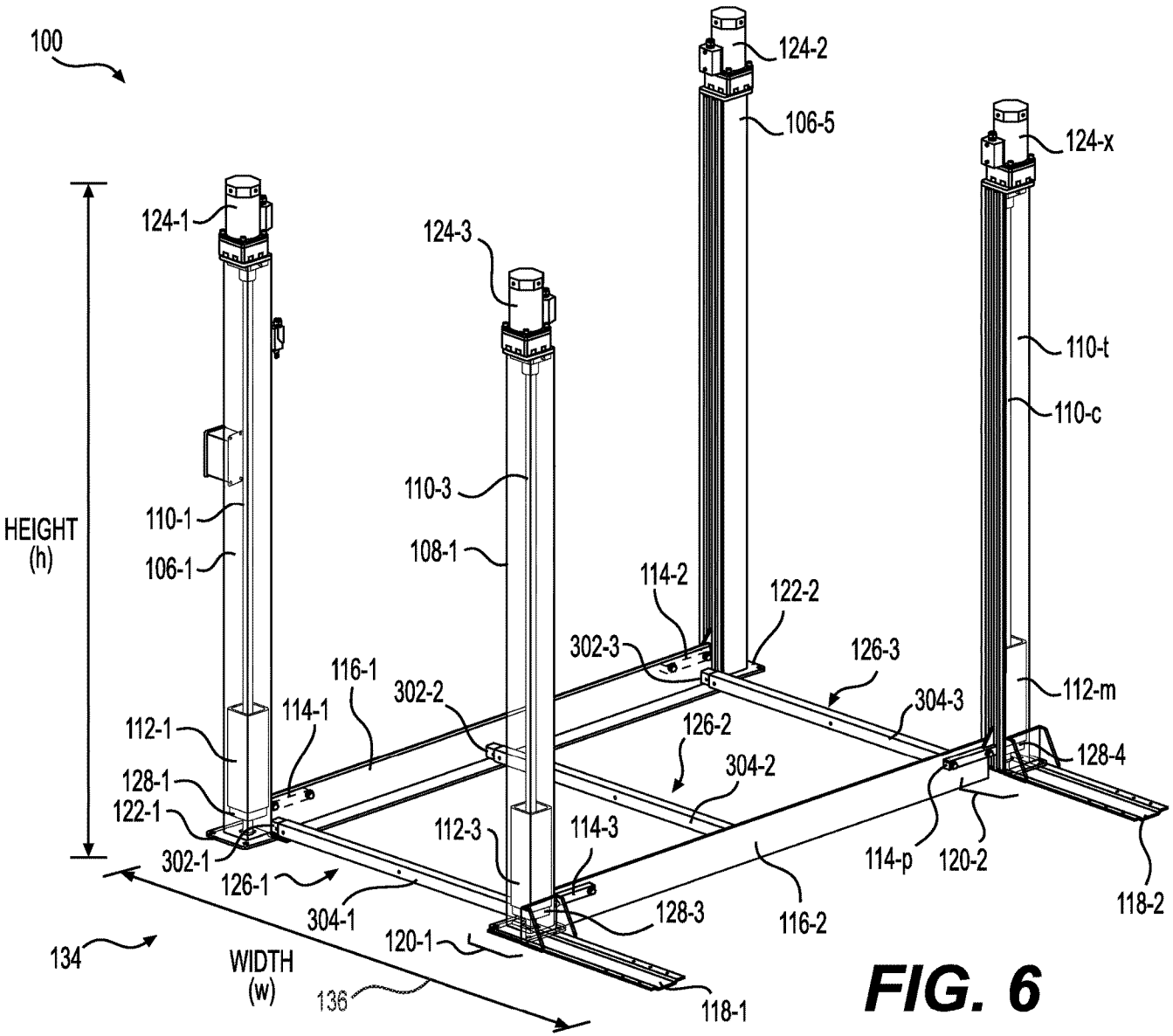
FIG. 6 is a schematic of the expandable lift system of FIG. 1 depicting the supports of the expandable lift system in the contracted state, according to an example of the principles described herein.

FIG. 4 is a schematic of the expandable lift system 100 of FIG. 1 depicting the expandable lift system 100 in a contracted state, according to an example of the principles described herein. Further, FIG. 5 is a schematic of the expandable lift system 100 of FIG. 1 depicting the expandable lift system 100 in hoisted position and a contracted state, according to an example of the principles described herein. Still further, FIG. 6 is a schematic of the expandable lift system 100 of FIG. 1 depicting the supports 126 of the expandable lift system 100 in the contracted state, according to an example of the principles described herein. The platform 102 as depicted in FIG. 4 includes panels 104-1, 104-2, and 104-3 still coupled to the supports 126, but not panel **104-*n*. Panel 104-*n* has been removed in FIG. 4 in order to allow the width (w) of the expandable lift system 100 to be contracted. In the examples described herein, any number of the panels 104 may be removed in order to reduce the width of the expandable lift system 100**.

Further, in the examples described herein, the width of the individual panels 104 may allow for different overall widths (w) of the platform 102. For example, if the number of panels 104 is doubled, and the width of each panel 104 is halved, the panels 104 would occupy approximately same width, but allow for more increments of available widths (w) in the platform 102 as panels 104 are added and removed. In an example, the length of the tracks 118-1, 118-2 may extend from a point between the stationary stanchions 106 and past the translatable stanchions 108 to allow for various widths (w) of the platform 102 to be achieved. In an example, the end of the tracks 118-1, 118-2 between the stationary stanchions 106 and the translatable stanchions 108 may be located at approximately the point at which the first portions 302 and the second portions 304 of the supports 126 are fully collapsed to their shortest telescopic length. Further, the end of the tracks 118-1, 118-2 past the translatable stanchions 108 may be located at approximately the point at which the first portions 302 and the second portions 304 of the supports 126 are fully extended to their longest telescopic length.

Although depicted as ending at a distance between the stationary stanchions 106 and the translatable stanchions 108, In an example, the length of the tracks 118-1, 118-2 may extend from the stationary stanchions 106 to the translatable stanchions 108 where the translatable stanchions 108 are fully extended away from the stationary stanchions 106. In an example, all the panels 104 and the supports 126 may be decoupled from the platform 102 to allow the translatable stanchions 108 to move to an abutting position with respect to the stationary stanchions 106 or at least juxtaposition to the stationary stanchions 106. As described herein, the tracks 118-1, 118-2 are strong enough and are shaped with a low enough profile shape to allow those vehicles to run over the tracks 118 without damaging the tracks 118 or the vehicle. In this manner, the utility of the expandable lift system 100 may be obtained while still allowing for a conservation of a space in which the expandable lift system 100 is installed.

The panels 104 may be coupled to the supports 126 via a number of returns 402 formed in at least one edge of the panels 104. The returns 402 are formed on the panels such that the returns 402 terminate below the elevation of the supports 126. For example, a return 402 may be formed on both sides of each of the panels 104 between the supports 126 but not on the supports 126. In this manner, the returns 402 hold the panels in place along the x-axis and y-axis of the platform 102 by creating stops against which the panels 104 seat. In an example, a top surface of at least one of the panels 104 may include a texturing to increase a coefficient of friction between the panels 104 and any object placed on the panels 104 of the platform. The texturing provides an anti-slip feature to the panels 104. In an example, the texturing may include a micro-abrasive texture such as a sand-paper-like texturing. In an example, the texturing may include a diamond plate texturing formed by stamping, embossing, pressing, hot rolling, and/or other types of manufacturing processes to form a regular pattern of raised diamond or lines on the top side of the panels.

As depicted in FIG. 6, the first portions 302 is almost completely inserted into the second portions 304 to a point at which the width (w) of the platform 102 is fully contracted. In an example, the tracks 118 may include stops (not shown) located at the ends of the tracks 118 to ensure that the translatable stanchions 108 do not run past and/or disengage with the tracks 118. More regarding the interface between the translatable stanchions 108 and the tracks 118 is described herein.

Figure 7:
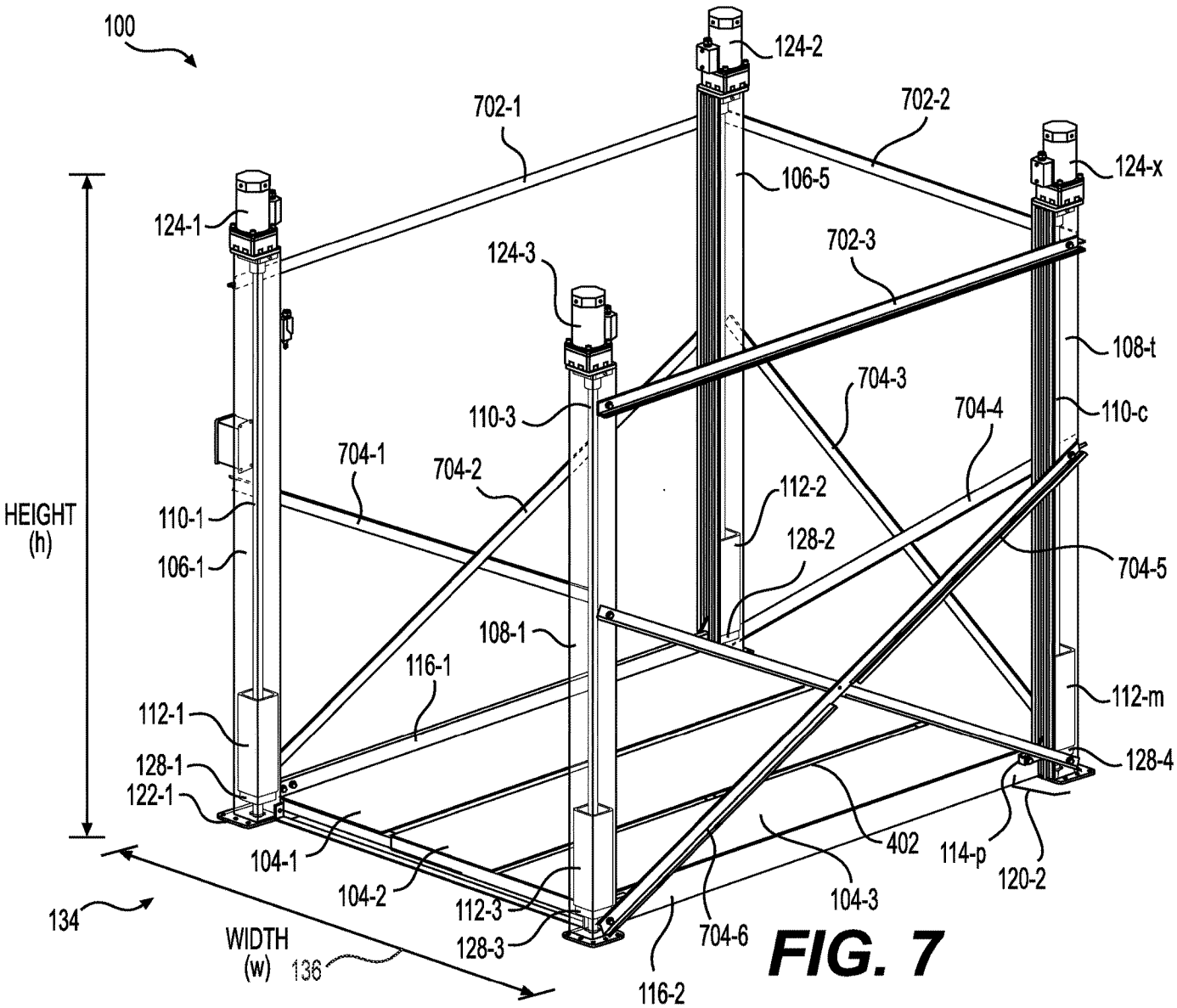
FIG. 7 is a schematic of the expandable lift system of FIG. 1 including a number of braces, according to an example of the principles described herein.

FIG. 7 is a schematic of the expandable lift system 100 of FIG. 1 including a number of braces, according to an example of the principles described herein. The braces may include a plurality of horizontal braces 702-1, 702-2, 702-3 (collectively referred to herein as horizontal brace(s) 702 unless specifically addressed otherwise). The horizontal braces 702 may include a first horizontal brace 702-1 coupling the first stationary stanchion 106-1 and the second stationary stanchion **106-*s*. The horizontal braces 702 may also include a second horizontal brace 702-2 coupling the second stationary stanchion 106-*s* and the second translatable stanchion 108-*t*. Further, the horizontal braces 702 may include a third horizontal brace 702-3 coupling the second translatable stanchion 108-*t* and the first translatable stanchion 108-1. The horizontal braces 702 resist lateral forces that may cause the stanchions 106, 108 to separate from one another or move toward one another, and, thus, ensure that the stanchions 106, 108** remain in a vertical position.

The braces may also include diagonal braces 704-1, 704-2, 704-3, 704-4, 704-5, 704-6 (collectively referred to herein as diagonal brace(s) 704 unless specifically addressed otherwise). The first diagonal brace 704-1 and second diagonal brace 704-2 couple the first stationary stanchion 106-1 and the second stationary stanchion **106-*s*. The third diagonal brace 704-3 and the fourth diagonal brace 704-4 couple the second stationary stanchion 106-*s* and the second translatable stanchion 108-*t*. The fifth diagonal brace 704-5 and the sixth fifth diagonal brace 704-6 couple the second translatable stanchion 108-*t* and the first translatable stanchion 108-1. The diagonal braces 704 resist lateral forces that may cause the stanchions 106, 108 to separate from one another or move toward one another, and, thus, ensure that the stanchions 106, 108** remain in a vertical position.

The horizontal braces 702 and the diagonal braces 704 may be coupled to the stanchions 106, 108 via fasteners, welding, or via other coupling methods and/or devices. Further, the diagonal braces 704 may be coupled to each other at a point at which the diagonal braces 704 intersect. In an example, a fastener may be used to couple a pair of diagonal braces 704 to one another at the point of intersection. In an example, the fastener may allow the pair of diagonal braces 704 to articulate relative to one another to allow the expandable lift system 100 to expand and contract to various widths (w) as described in more detail herein.

The horizontal braces 702 and the diagonal braces 704 may have an L-shaped cross-section in order to provide rigidity and strength to the horizontal braces 702 and the diagonal braces 704. The two portions of the L-shaped cross-section strengthen the braces 702, 704 by acting as flanges that resist the bending moment of the braces 702, 704. The braces 702, 704 may include different cross-sections that allow for strengthening of the braces 702, 704.

In one example, the horizontal braces 702 and the diagonal braces 704 may be expandable such that when the platform 102 of the expandable lift system 100 is expanded or contracted, the horizontal braces 702 and the diagonal braces 704 may remain coupled to the stanchions 106, 108 during the expansion and/or contraction. In one example, the diagonal braces 704 may be couplable to a number of different locations along the height of the stanchions 106, 108 to allow for the diagonal braces 704 to be coupled to the stanchions 106, 108 at various widths of the platform 102 as the platform is expanded and/or contracted. In this example, the diagonal braces 704 may be rotatably coupled to one another as pairs to allow for the diagonal braces 704 to articulate with respect to one another and couple at various portions along the stanchions 116, 118. In one example, the locations at which the diagonal braces 704 coupled along the length of the stanchions 116, 118 may be defined based at least in part on the discrete widths of the platform 102.

In FIG. 7, the space between the first stationary stanchion 106-1 and the first translatable stanchion 108-1 may be left void of any braces 702, 704 in order to allow an object to enter the expandable lift system 100 and be placed on the platform 102. In this manner, a vehicle such as, for example, a vehicle may enter the end of the platform 102 not obscured by the braces 702, 704, and be hoisted by the expandable lift system 100. In some examples, one or more of the braces 702, 704 depicted in FIG. 7 may not be included, or more than those braces 702, 704 depicted may be included. In an example, the expandable lift system 100 may not include the braces 702, 704.

In FIG. 7, the expandable lift system 100 is in a contracted state as similarly depicted in FIGS. 4-6. In an example, the second horizontal brace 702-2, the third diagonal brace 704-3, and the fourth diagonal brace 704-4 are depicted as coupling the second stationary stanchion **106-*s* to the second translatable stanchion 108-*t*. In an example, the second horizontal brace 702-2, the third diagonal brace 704-3, and the fourth diagonal brace 704-4 may not be included in the expandable lift system 100 in order to allow the expandable lift system 100** to expand and contract to various widths (w).

In another example, the third diagonal brace 704-3 and the fourth diagonal brace 704-4 may be included. In an example, the third diagonal brace 704-3 and the fourth diagonal brace 704-4 may be articulatable relative to one another, and may move along a length of the second stationary stanchion **106-*s* to the second translatable stanchion 108-*t*. For example, the third diagonal brace 704-3 and the fourth diagonal brace 704-4 may be coupled to a channel defined along a length of the second stationary stanchion 106-*s* to the second translatable stanchion 108-*t*. This example allows for the third diagonal brace 704-3 and the fourth diagonal brace 704-4 to remain coupled to the expandable lift system 100 to support the second stationary stanchion 106-*s* to the second translatable stanchion 108-*t* while still allowing the expandable lift system 100** to expand and contract to various widths (w).

Figure 8:
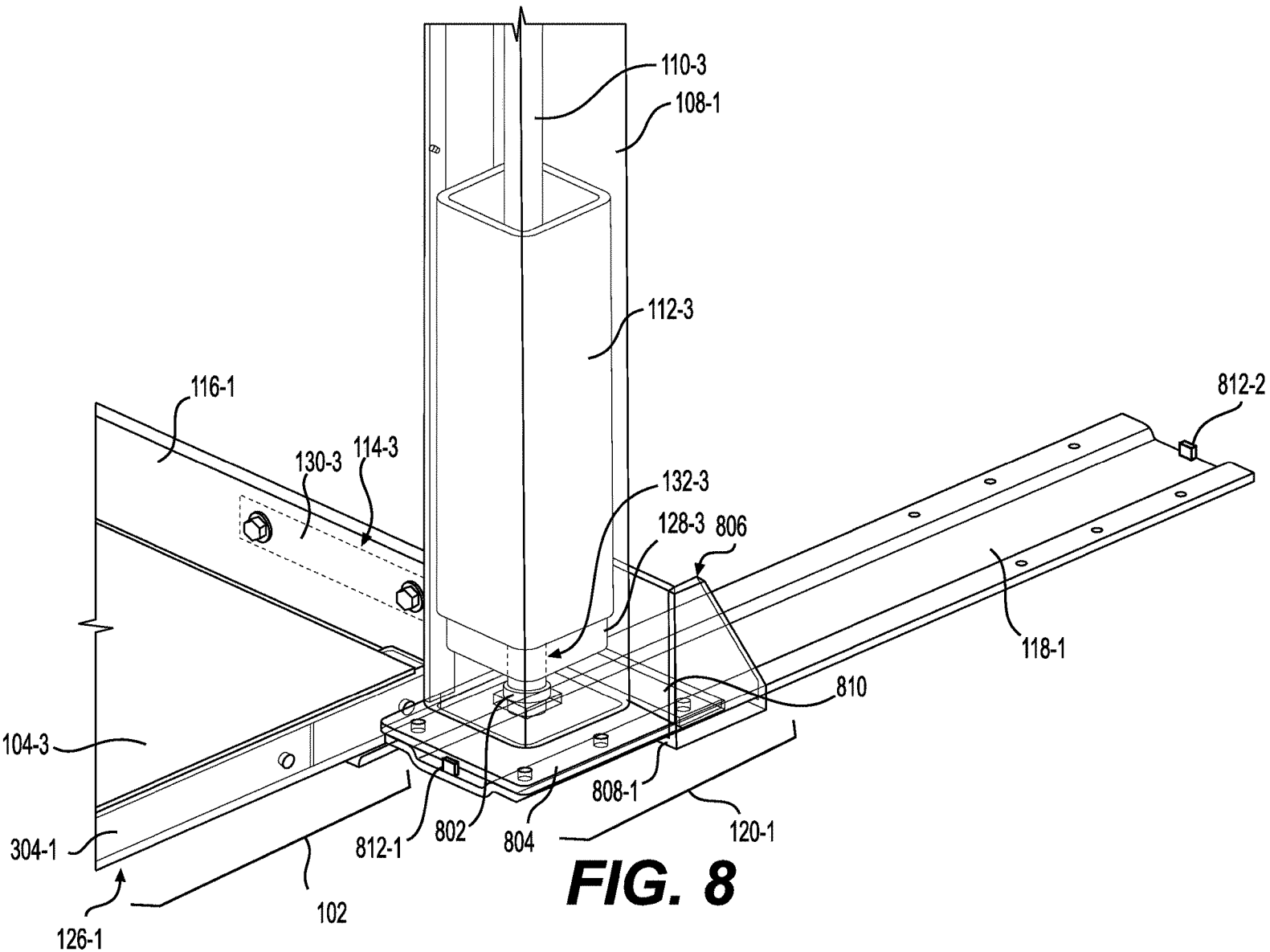
FIG. 8 is a schematic of a stanchion/platform interface of the expandable lift system, according to an example of the principles described herein.
Figure 9:
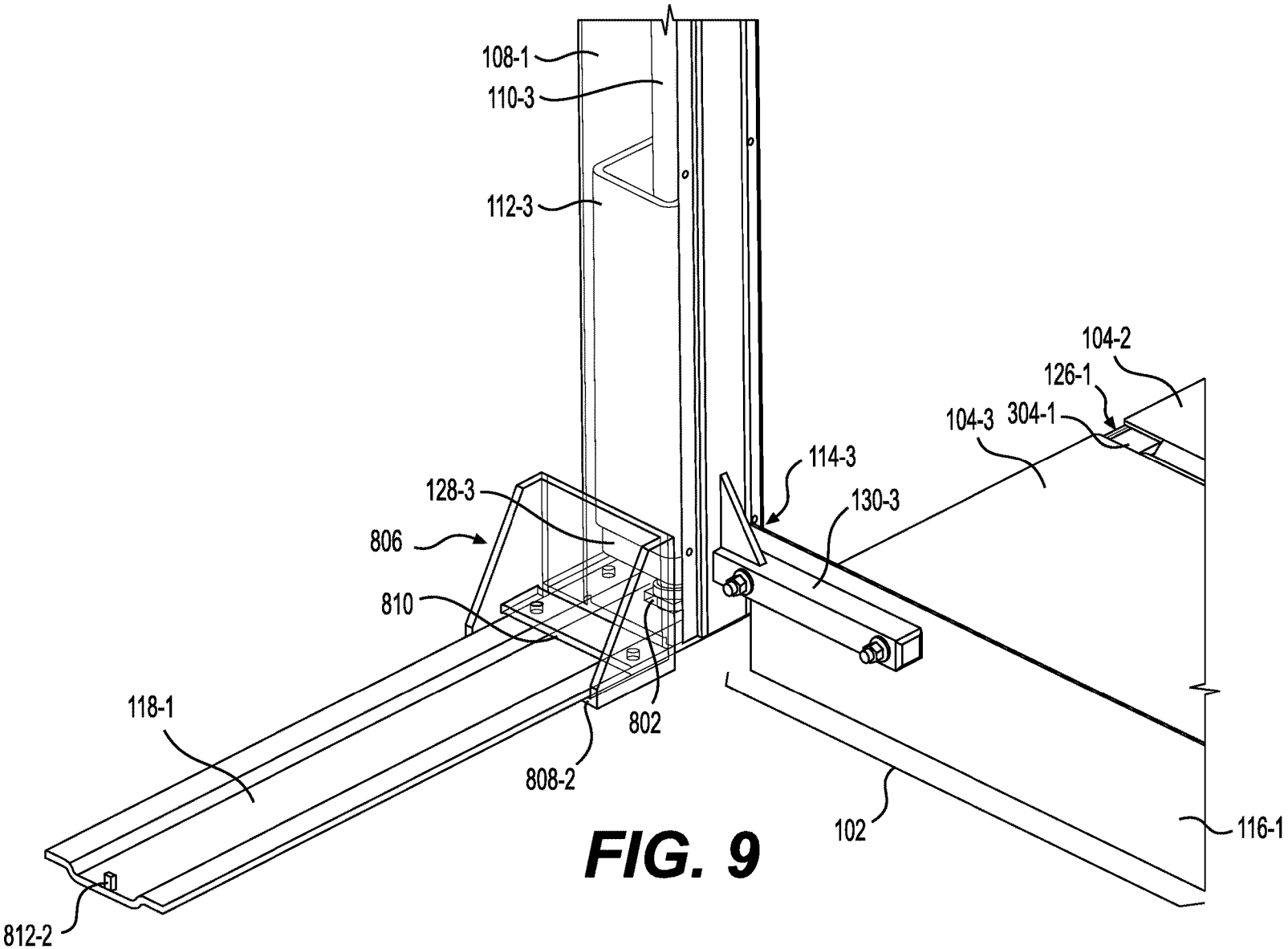
FIG. 9 is a schematic of a stanchion/platform interface of the expandable lift system, according to an example of the principles described herein.

FIG. 8 is a schematic of a stanchion/platform interface of the expandable lift system 100, according to an example of the principles described herein. Further, FIG. 9 is a schematic of a stanchion/platform interface of the expandable lift system 100, according to an example of the principles described herein. The detailed view of the first translatable stanchion 108-1 of FIGS. 8 and 9 includes a depiction of the base portion 120-1, platform 102, the third panel 104-3 (given the expandable lift system 100 is in a contracted state as depicted in FIGS. 4-7), the second side rail 116-2, and the first track 118-1. The third jack mount 112-3 is coupled to the jack mount base 128-3, and the jack mount base 128-3 is coupled to the first side rail 116-1 of the platform 102 via the third platform mount 114-3. The third screw drive 110-3 of the first translatable stanchion 108-1 is threadingly engaged with the jack mount base 128-3 such that when the third motor 124-3 is activated, the screw drive 110-3 causes the third jack mount 112-3 to move up or down based on the direction of rotation of the third motor 124-3 and third screw drive 110-3.

As depicted in FIGS. 8 and 9, the first translatable stanchion 108-1 includes a bottom plate 804 coupled to the bottom of the first translatable stanchion 108-1. The elements described in connection with the first translatable stanchion 108-1 are similarly applicable as to all the stanchions 106, 108 described herein. In an example, the bottom plate 804 may be coupled to the first translatable stanchion 108-1 via a process of monolithically forming the bottom plate 804 with the first translatable stanchion 108-1, welding the bottom plate 804 to the first translatable stanchion 108-1, or other means. A bushing 802 is coupled to the bottom plate 804 at a location on the bottom plate 804 where a longitudinal axis of the screw drive 110-3 terminates. The bushing 802 may be any bushing or bearing device that provides a bearing surface to support the rotation of the screw drive 110-3. In an example, the bushing 802 may include a plain bearing, a solid bushing, a split bushing, a clenched bushing, ball bearings, roller bearings, thrust bearings, spherical bearings, linear bush bearings, other types of bushings and/or bearings, and combinations thereof. In an example, the screw drive 110-3 may include a non-threaded portion that interfaces with the bushing 802. In one example, the expandable lift system 100 may include any number of grease fitting, zerk, nipple, or other lubricant insertion at various locations to allow for lubricant such as grease to be introduced into the stanchions 106, 108.

The bottom plate 804 is coupled to a track guide 806 via welding, fasteners, or other means. The track guide 806 is dimensioned to slidingly couple the bottom plate 804 to allow the bottom plate 804 and the associated translatable stanchion 108 to move along the length of the track 118 such as the track 118-1 depicted in FIGS. 8 and 9. The track guide 806 may include a bar 810 coupled to the bottom plate 804. In an example, the bar 801 is monolithically formed with the bottom plate 804. In other examples, the bar 801 may be welded to or fastened to the bottom plate 804. A first engaging portion 808-1 and a second engaging portion 808-2 are coupled to the bar 810. The first engaging portion 808-1 and a second engaging portion 808-2 include portions that extend from a location where the bar 810 is coupled to the first engaging portion 808-1 and a second engaging portion 808-2 to where the first engaging portion 808-1 and a second engaging portion 808-2 wrap around a bottom edge of the track 118-1. In this manner, the track guide 806 slidingly engages the track 118-1 to allow the expandable lift system 100 to expand and contract to various widths (w).

In FIGS. 8 and 9, the first engaging portion 808-1 and a second engaging portion 808-2 of the track guide 806 wrap around the exterior edges of the track 118-1. In an example, the track guide 806 may include portions that slidingly interface with interior portions of the track 118-1. In an example, the edges of the track 118-1 may turn down towards the substructure 134 on which the expandable lift system 100 sits. In an example, the edges of the track 118-1 may act as an incline plane over which vehicles or other objects may move over.

The bottom plates 804 of the translatable stanchions 108 are not coupled to the substructure 134 on which the expandable lift system 100 sits. In contrast, the bases 122 of the stationary stanchions 106 are coupled to the substructure 134 as described herein. The track 118-1 to which the translatable stanchions 108 are slidingly coupled are coupled to the substructure 134 to provide rigidity between the translatable stanchions 108 and the substructure 134 in a direction perpendicular to a longitudinal axis of the track 118.

At least one of the tracks 118 may include a first stop 812-1 and a second stop 812-2 (collectively referred to herein as stop(s) 812 unless specifically addressed otherwise). The stops 812 ensure that the base portions 120 including the track guides 806 do not run off the tracks 118. In an example, the expandable lift system 100 may retain the base portions 120 including the track guides 806 in an engaged state with the tracks 118 by the limiting movement of the supports 126 to the two extents of the tracks 118.

Figure 10:
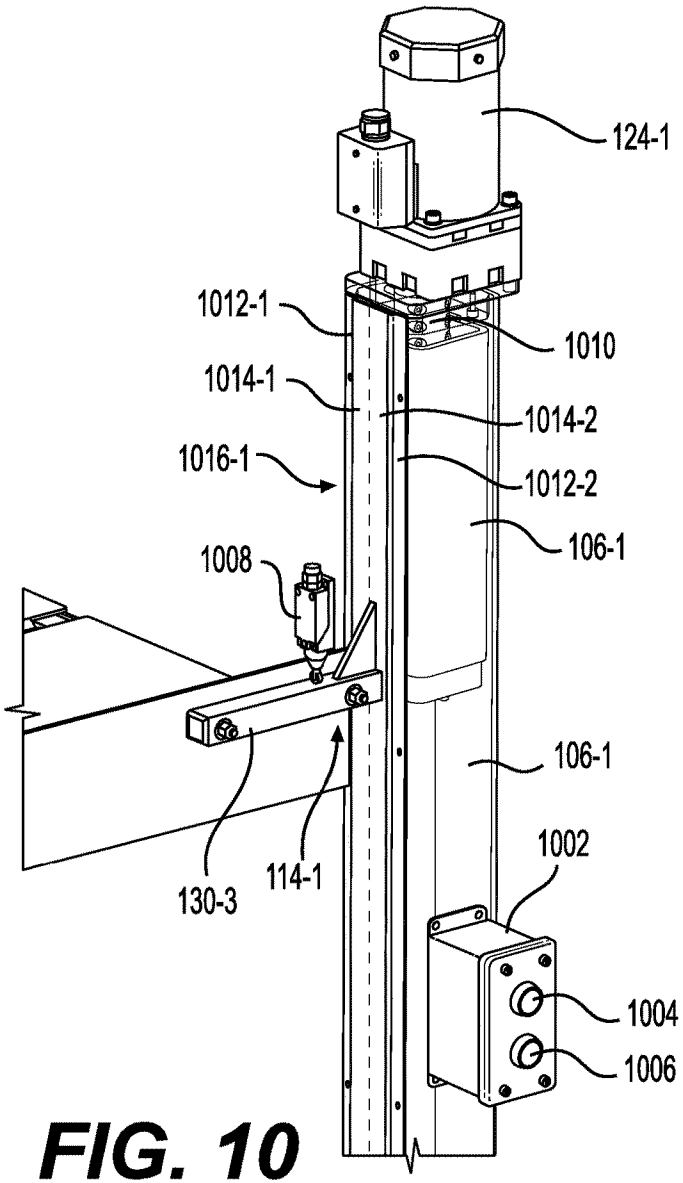
FIG. 10 is a schematic of a stanchion/motor interface of the expandable lift system, according to an example of the principles described herein.

FIG. 10 is a schematic of a stanchion/motor interface of the expandable lift system 100, according to an example of the principles described herein. The first stationary stanchion 106-1 is depicted in FIG. 10. The elements described in connection with FIG. 10 may apply to all the stanchions 106, 108 within the expandable lift system 100.

The motor 124-1 may be mechanically coupled to the screw drive 110-1 of the stationary stanchion 106-1 via a coupler 1010. In an example, the coupler 1010 may include a key that couples the shaft of the motor 124-1 with the screw drive 110-1. In an example, the rotor of the motor 124-1 and the screw drive 110-1 include a keyway and a key seat defined therein to accept the key. The key, when seated within the keyway and the keyseat may prevent relative rotation between the two parts and enable torque transmission from the motor 124-1 to the screw drive 110-1. The coupler 1010 surrounds the key, keyway, and keyseat, and is secured using a number of fasteners. The coupler 1010 retains the key in a seated position. In this manner, the motor 124-1, when activated, is able to transfer torque to the screw drive 110-1 in both a clockwise and counterclockwise directions to hoist and lower the platform 102.

A control interface 1002 may be included on any one of the stanchions 106, 108, and is depicted as being installed on the first stationary stanchion 106-1. The control interface 1002 includes a first selection button 1004 and a second selection button 1006. The first selection button 1004, when selected by a user, activates the motor 124-1 to cause the motor 124-1 to turn the screw drive 110-1 in a direction that causes the platform 102 to be hoisted or lifted. The second selection button 1006, when selected by the user, activates the motor 124-1 to cause the motor 124-1 to turn the screw drive 110-1 in a direction that causes the platform 102 to be dropped or lowered and opposite that direction when the first selection button 1004 is depressed.

The control interface 1002 is electrically and communicatively coupled to each motor 124 for each of the stanchions 106, 108 to activate the motors 124. In an example, the control interface 1002 may include control logic that causes the motors 124 synchronously drive the screw drives 110 of each stanchion 106, 108 at the same rate such that the motors 124 operate at the same or substantially the same rotations per minute (rpm). Synchronously rotating the screw drives 110 ensures that the platform 102 to remain level in two coordinate directions and along a common plane. Maintaining a level plane along the surface of the platform 102 in this manner ensures that objects resting on the platform 102 do not roll or slide off the platform. The control logic of the control interface 1002 may be embodied as one or more of a processor, a memory, an application specific integrated circuit, other processing or logic device, and combinations thereof.

The expandable lift system 100 may also include a position sensor 1008 to determine a position of the platform 102 with relation to the stanchions 106, 108 and the substructure 134. The position sensor may include, for example, a limit switch. A limit switch may be provided to limit the upward translation of the platform 102 to a fully elevated position or another position along the height of the stanchions 106, 108 where an object placed on the platform 102 is not pushed into a structure such a ceiling. In an example, the limit switch may be slidably mounted to the stanchion 106, 108 and is dimensioned to engage a shut-off switch (not shown) associated with and wired to the control interface 1002. The limit switch, in an example, is configured to deactivate the expandable lift system 100 upon the platform 102 being raised to an elevated position where it abuts the limit switch. In an example, the shut-off switch may not prevent the lowering of the platform 102 after being triggered by the limit switch.

Other examples of position sensors 1008 may include capacitive displacement sensors, Eddy-current sensors, Hall effect sensors, inductive sensors, optical sensors, photodiode sensors, piezo-electric transducers, position encoders, potentiometers, proximity sensors, ultrasonic sensors, among a myriad of other types of sensors. The position sensors 1008 may relay information to the control interface 1002 to indicate to the control interface the position of the platform 102.

In one example, the motors 124 may include the position sensor 1008. In this example, the position sensor 1008 may detect forces, rotations of the screw drives 110, pressures associated with the lifting of the platform 102, or other states related to the position of the platform 102. The motors 124 may determine when to shut down or deactivate when a predetermined value on the position sensor 1008 indicates that a height of the platform 102 has reached a maximum.

With reference to FIGS. 1 through 10, and, specifically, FIGS. 9 and 10, the stanchions 106, 108 of the expandable lift system 100 may include a pair of seal supports 1012-1, 1012-2 including a first seal support 1012-1 and a second seal support 1012-2 (collectively referred to herein as seal support(s) 1012 unless specifically addressed otherwise). The seal supports 1012 are coupled to a side of the stanchions 106, 108 at which the arms 130 of the platform mounts 114 protrude through a channel 1016-1 defined in the housing of the stanchions 106, 108. The seal supports 1012 are coupled to the two sides of the channel 1016-1.

A first seal 1014-1 is coupled to the first seal support 1012-1 and a second seal 1014-2 is coupled to the second seal support 1012-2. The seals are collectively referred to herein as seal (s) 1014 unless specifically addressed otherwise. The seals 1014 may include an elastically deformable material such as, for example, a rubber material or a silicone material. The elastic deformation properties of the seals 1014 allow for the platform mounts 114 to move along a length of the stanchions 106, 108 past the seals 1014 as the platform 102 is hoisted and lowered. The seals 1014 are biased to form around the platform mounts 114. Thus, the seals 1014 close the channels 1016 defined in the stanchions 106, 108 and reduce or eliminate contaminants from entering into the interior portions of the stanchions 106, 108.

Figure 11:
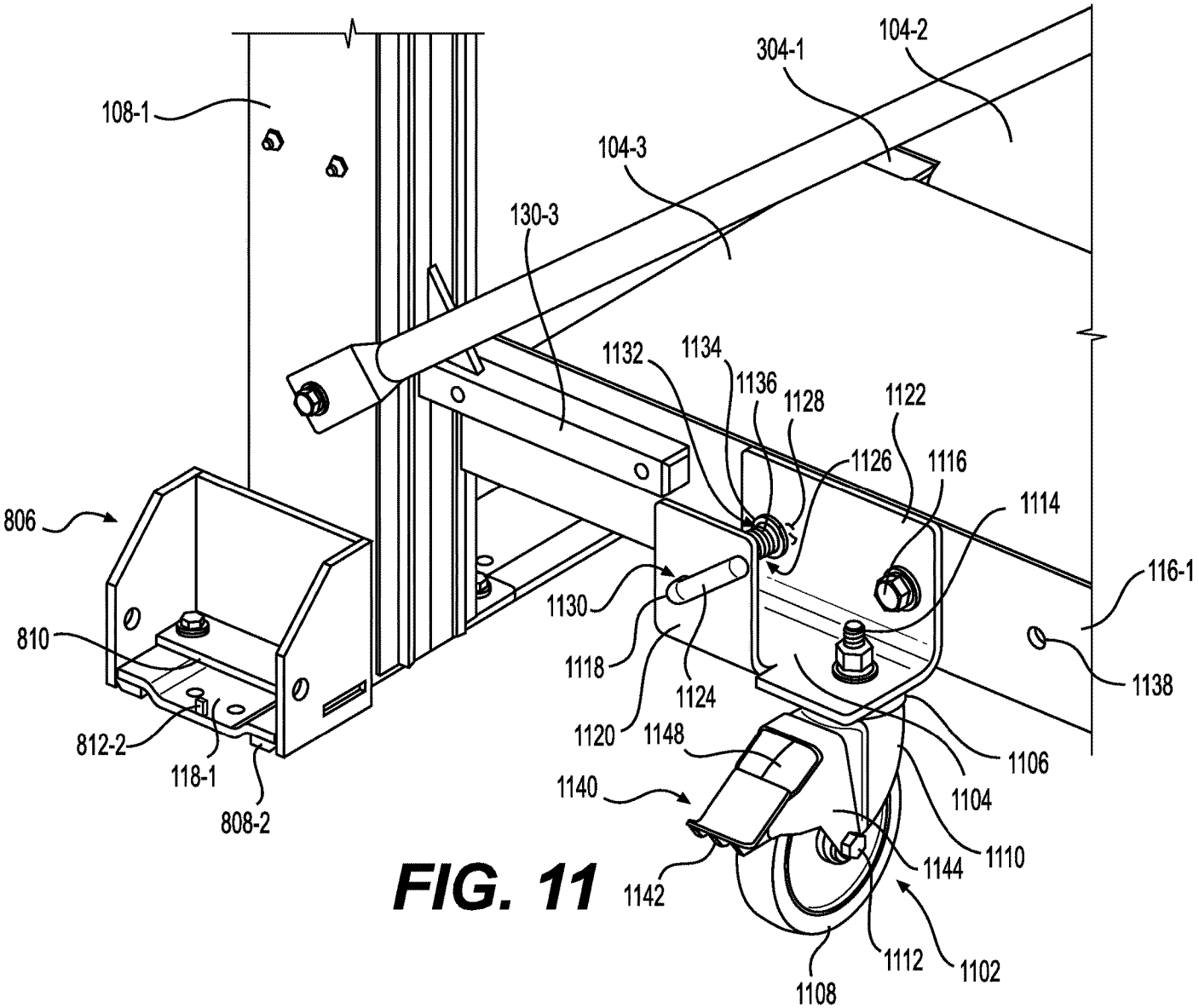
FIG. 11 is a schematic of a caster device of the expandable lift system in an engaged position, according to an example of the principles described herein.
Figure 12:
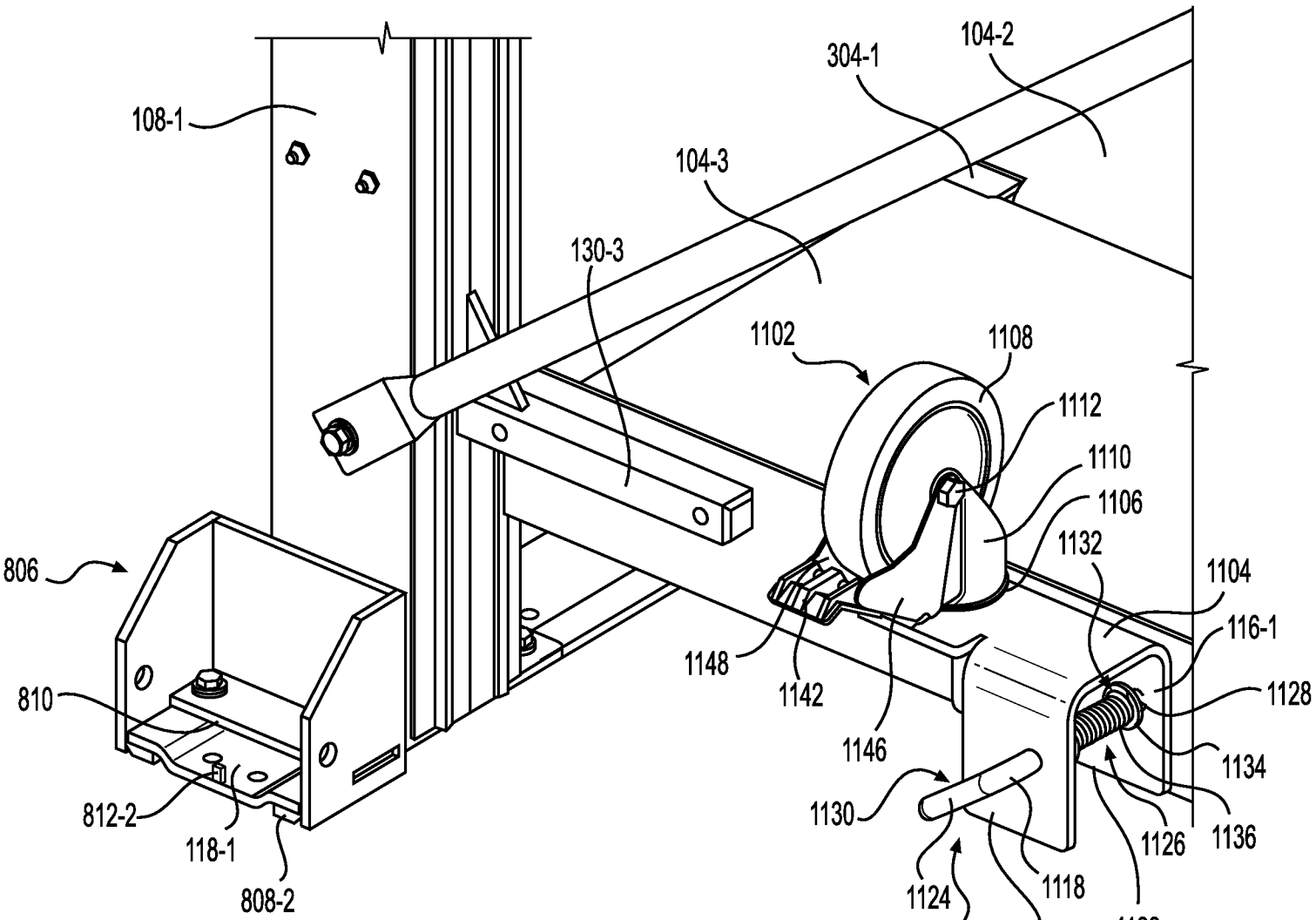
FIG. 12 is a schematic of a caster device of the expandable lift system in a disengaged position, according to an example of the principles described herein.

FIG. 11 is a schematic of a caster device 1100 of the expandable lift system 100 in an engaged position, according to an example of the principles described herein. Further, FIG. 12 is a schematic of a caster device 1100 of the expandable lift system 100 in a disengaged position, according to an example of the principles described herein. In some examples, the expandable lift system 100 may not be secured to the 134 to allow the expandable lift system 100 to be moved. In an example, the base(s) 120, 122 and/or the tracks 118 may not be secured to the substructure. This allows, for example, for the expandable lift system 100 to be moved within a garage such that the expandable lift system 100, when in use, may be moved to a first position within the garage, and, when not in use, may be stored in a second portion of the garage.

To assist in the movement of the expandable lift system 100, a number of caster devices 1100 may be coupled to, for example, the side rails 116-1, 116-2 of the platform 102. Although one caster device 1100 is depicted as being coupled to the second side rail 116-2, any number of caster devices 1100 may be coupled to the side rails 116-1, 116-2 to allow for safe, mechanically-assisted movement of the expandable lift system 100.

The caster devices 1100 may include a caster 1102, a carrier 1104, and a spring-biased pin 1118. The caster 1102 may be any single, double, or compound wheel that is attached to a substrate such as the carrier 1104 depicted in FIGS. 11 and 12. The caster 1102 is rotatably coupled to the carrier 1104 via, for example, a ball bearing 1106 or other rotatable bearing device. Further, a wheel 1108 of the caster 1102 may be mounted to a fork 1110 via a bolt 1112 running through the wheel 1108 and acting as an axel of the caster 1102. In this manner, the wheel 1108 may rotate about the bolt 1112, and the fork 1110 may rotate about the ball bearing 1106. In this manner, the caster 1102 both pivots or pintles such that the wheel 1108 will automatically align itself to the direction of travel and will rotate about the bolt 1112 to allow for movement of the caster 1102 and anything attached to it in that direction of travel.

The caster 1102 is coupled to a carrier 1104 as described above. The caster 1102 may be coupled to the carrier 1104 using a carrier bolt 1114. The carrier 1104 may be rotatably coupled to the side rail 116-1, 116-2 via a side rail bolt 1116. The side rail bolt 1116 may include any number of washers, bushings, bearings, or other devices that allow the side rail bolt 1116 to rotate along its longitudinal axis without becoming uncoupled from the carrier 1104 and/or the side rail 116-1, 116-2. As depicted in the different orientations of the caster devices 100 in FIGS. 11 and 12, this rotatable characteristic of the caster device 1100 allows the caster device 1100 to be oriented in a first orientation (e.g., orientation as depicted in FIG. 11) and a second orientation (e.g., orientation as depicted in FIG. 12).

A brake 1140 may also be included in the caster device 1100. The brake 1140 may include a brake lever 1142, a first arm 1144 extending from the brake lever 1142 and coupled to the bolt 1112, a second arm 1146 extending from the brake lever 1142 and coupled to the bolt 1112, and a brake cam 1148. The brake lever 1142, when pressed by a user, causes the brake lever 1142 to rotate about the bolt 1112 via the first arm 1144 and the second arm 1146, and causes the brake cam 1148 to engage with the wheel 1108. As the brake cam 1148 engages with the wheel 1108, the wheel is restricted from rotating. This leads to the inability to move the expandable lift system 100 from one location to another as described herein.

The caster device 1100 may also include a spring-biased pin 1118. The spring-biased pin 1118 extends through a first arm 1120 and a second arm 1122 formed from the carrier 1104. Thus, the spring-biased pin 1118 may include an L-shaped pin. Thus, the spring-biased pin 1118 includes a handle 1124 and a shaft 1126 formed perpendicular to the handle 1124. The handle 1124 is grasped by the user and pulled away from the caster device 1100 in order to disengage a distal end of the shaft 1126 from a first aperture 1128 formed or defined in the side rail 116-1, 116-2 (shown in ghost in FIG. 11). A second aperture 1138 is also formed or defined in the side rail 116-1, 116-2 to receive the shaft 1126 when the caster device 1100 is oriented as depicted in FIG. 12.

A protrusion 1134 or other stopping device may be formed along the length of the shaft 1126 between the first arm 1120 and the second arm 1122 of the carrier 1104. The protrusion 1134 serves to ensure that the spring-biased pin 1118 cannot be removed from the carrier 1104 as the diameter of the protrusion is larger relative to a first arm aperture 1130 and a second arm aperture 1132 formed or defined in the first arm 1120 and the second arm 1122, respectively. In this manner, the spring-biased pin 1118 may be pulled from the carrier 1104 a certain distance that allows the distal end of the shaft to disengage from the first aperture 1128 of the side rail 116-1, 116-2, but is retained within the carrier 1104 via the protrusion 1134. The protrusion 1134 may take the form of a mass of material formed along the shaft 1126, a washer welded to the shaft 1126, or other type of stopping and retention device.

The spring-biased pin 1118 also includes a spring 1136 coaxially coupled to the shaft 1126 between the first arm 1120 and the second arm 1122. The spring 1136 is a compression formed to bias the spring-biased pin 1118 into an engaged state with the carrier 1104 and the side rail 116-1, 116-2. In an example, the spring 1136 may be coupled to the protrusion formed on the shaft 1126. When a user pulls the handle 1124 of the spring-biased pin 1118, the force exerted on the spring 1136 causes the spring 1136 to compress between the first arm 1120 and the protrusion 1134. When the user releases the handle 1124 of the spring-biased pin 1118, the spring 1136 forces the protrusion 1134 away from the first arm 1120 causing the shaft 1126 to bias toward the side rail 116-1, 116-2 and into engagement with one of the first aperture 1128 or a second aperture 1138 formed or defined in the side rail 116-1, 116-2.

As the carrier 1104 is rotated about the side rail bolt 1116 after the spring-biased pin 1118 is disengaged from the first aperture 1128 or a second aperture 1138 formed or defined in the side rail 116-1, 116-2, the caster device 1100 may be rotated in an engaged position (e.g., the first orientation) as depicted in FIG. 11, and a disengaged position (e.g., the second orientation) as depicted in FIG. 12. As depicted in FIG. 11, the platform 102 must be raised to a predetermined height before the caster device 1100 may be placed in the engaged position (e.g., the first orientation) as depicted in FIG. 11. For example, in operation the user lifts the platform 102 to a height at least as least as high as a vertical length of the caster device 1100. The motors 124 may be activated as described herein to raise the platform 102. The raising of the platform 102 allows the carrier 1104 to rotate from the disengaged position (e.g., the second orientation) as depicted in FIG. 12 to the engaged position (e.g., the first orientation) as depicted in FIG. 11 such that the wheel 1108 clears the substructure 134 and the spring-biased pin 1118 can engage with the first aperture 1128 of the side rail 116-1, 116-2.

With the caster device 1100 in the engaged position (e.g., the first orientation) as depicted in FIG. 11, the user may then cause the platform 102 to be lowered such that the wheel 1108 engages with the substructure 134. The platform 102 may be further lowered such that relatively more weight of the expandable lift system 100 is exerted on the wheel 1108 of the caster device 1100, and the expandable lift system 100 is lifted by the caster device 1100. As mentioned herein, any number of caster devices 1100 may be coupled to the side rails 116-1, 116-2. In an example, the number of caster devices 1100 coupled to the side rails 116-1, 116-2 may be based on the weight of the expandable lift system 100 such that the caster devices 1100 are able to support the weight of the expandable lift system 100. In another example, the number of caster devices 1100 coupled to the side rails 116-1, 116-2 may be based on the weight of the expandable lift system 100 plus an additional predetermined weight such that the caster devices 1100 are able to support the weight of the expandable lift system 100 plus the additional predetermined weight.

In the examples described herein, requiring that the platform 102 to be lifted to engage the caster devices 1100 and also requiring that the platform 102 be lowered to cause the caster devices 1100 to bear the weight of the expandable lift system 100 provides a safety measure when operating the expandable lift system 100. The position of the caster devices 1100 on the side rails 116-1, 116-2 require that the platform 102 of the expandable lift system 100 be lowered to almost a lowest position of the platform 102 in order for the caster devices 1100 to engage with the substructure 134 and bear the weight of the expandable lift system 100. This ensures that even if the user improperly places a load on the platform 102, the load cannot be raised to a position via the platform 102 where the load creates a risk of safety to the user if the expandable lift system 100 were moved. Specifically, if a load were raised on the platform 102, and the expandable lift system 100 were allowed to be moved, the load may topple over and harm the user, and/or destroy the user's property or the expandable lift system 100. Thus, with the safety measures afforded by the placement of the caster devices 1100, even if the user were to place a load on the platform during movement of the expandable lift system 100 via the caster devices 1100 (which is not recommended), the load may not create a safety risk.

In the example of FIGS. 11 and 12, the horizontal brace(s) 702 and/or the diagonal brace(s) 704 may be installed in order to create stability to the expandable lift system 100 when the expandable lift system 100 is being transported via the caster devices 1100. Further, in an example, the caster devices 1100 may be sold as a separate device relative to the expandable lift system 100 and/or as a kit along with the expandable lift system 100.

Figure 13:
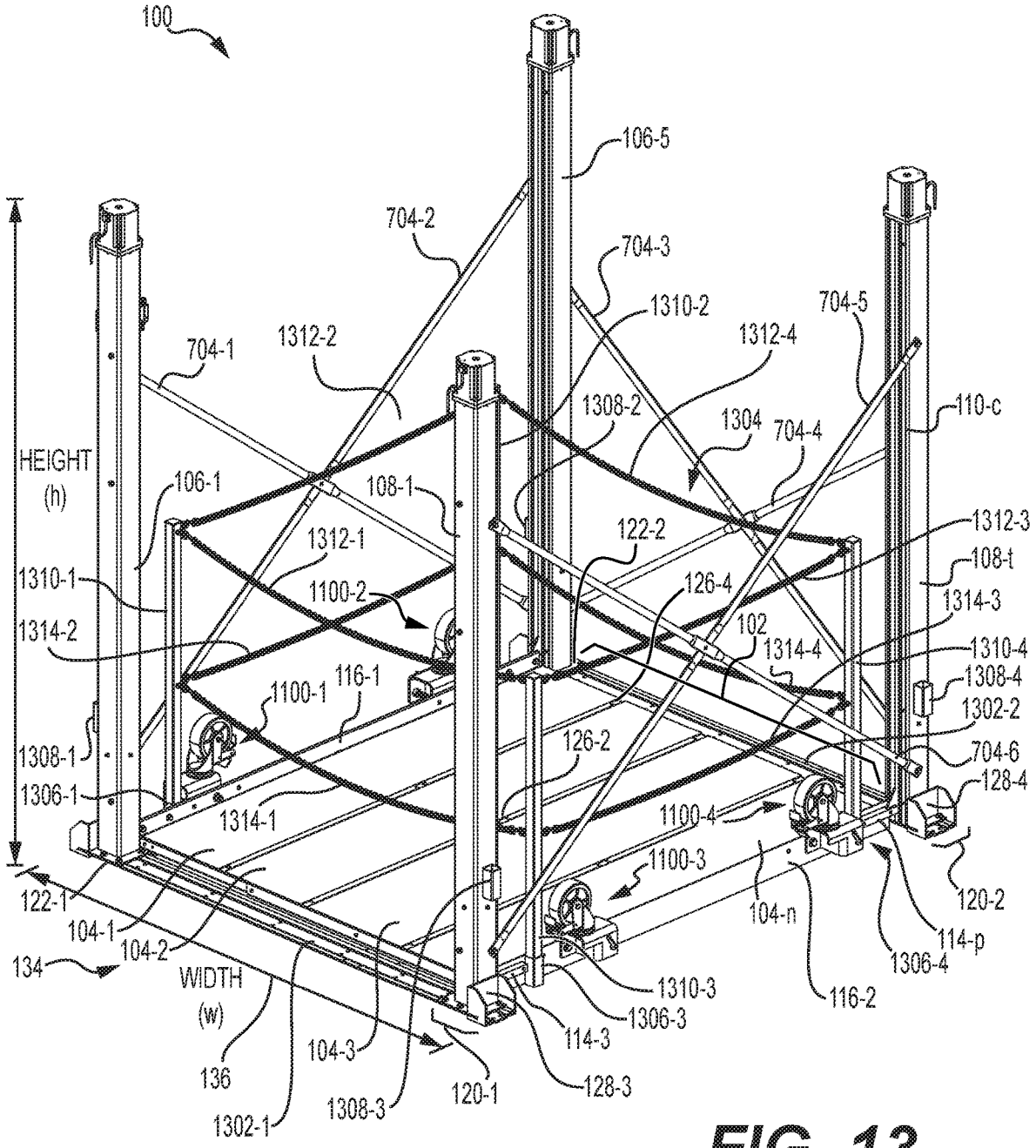
FIG. 13 is a schematic of an expandable lift system including a full-length track and a safety rail system, according to an example of the principles described herein.
Figure 14:
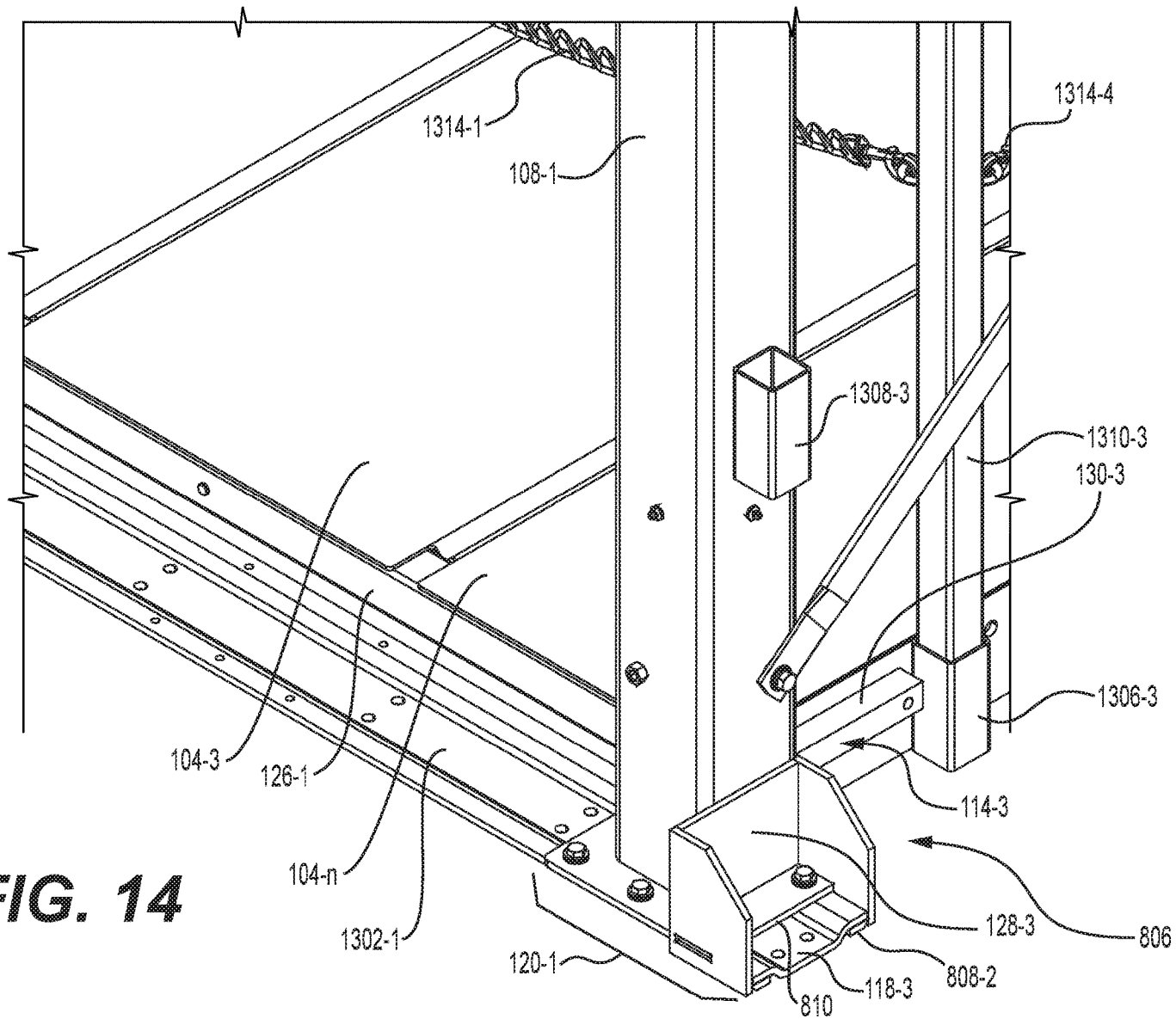
FIG. 14 is a schematic of the expandable lift system of FIG. 13 depicting a first close-up view of the full-length track and a safety rail system, according to an example of the principles described herein.
Figure 15:
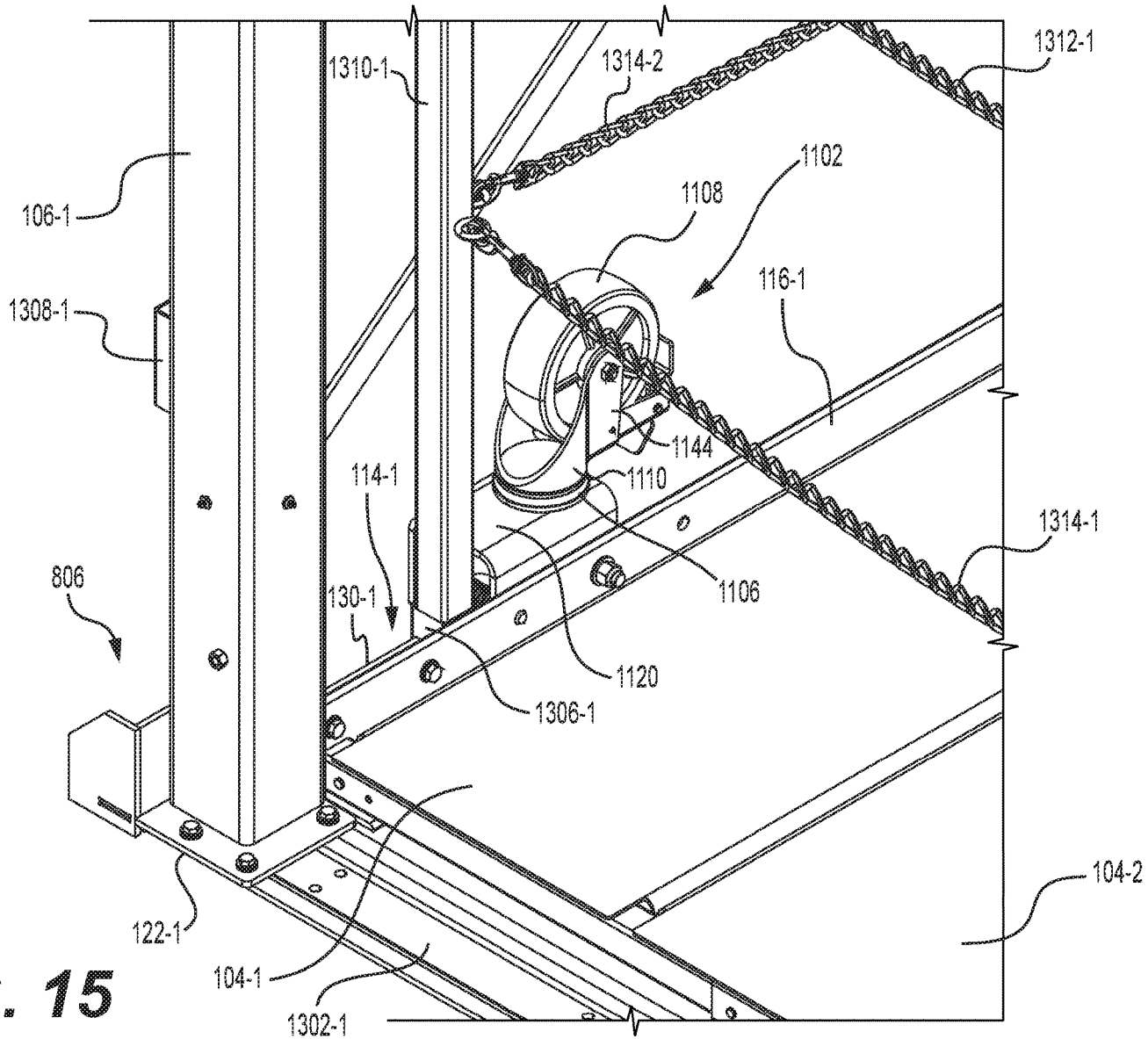
FIG. 15 is a schematic of the expandable lift system of FIG. 13 depicting a second close-up view of the full-length track and a safety rail system, according to an example of the principles described herein.
Figure 16:
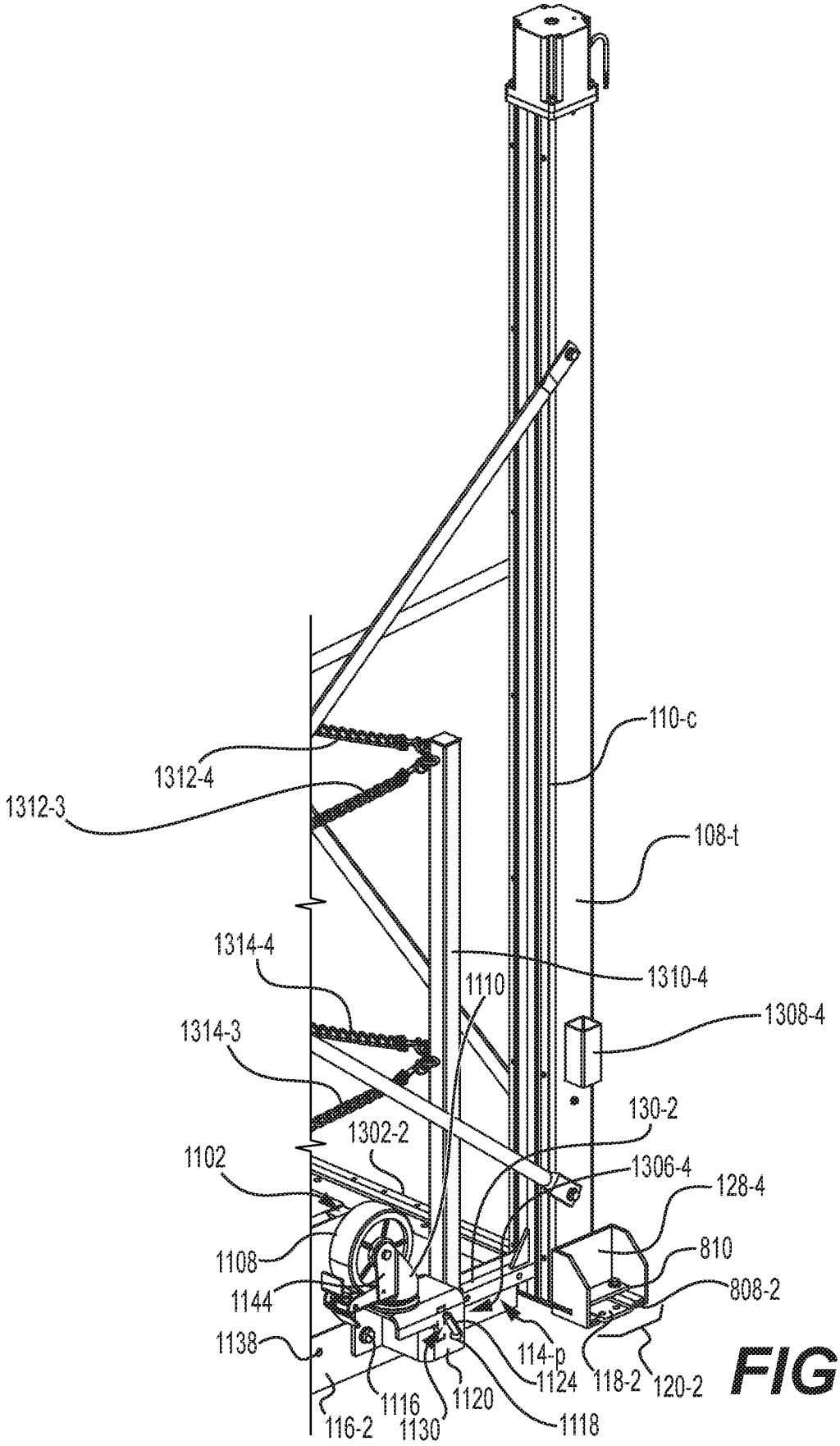
FIG. 16 is a schematic of the expandable lift system of FIG. 13 depicting a first close-up view of the full-length track and a safety rail system, according to an example of the principles described herein.

A full-length track 1302 and a safety rail system 1304 will now be described in connection with FIGS. 13 through 16. FIG. 13 is a schematic of an expandable lift system 100 including a full-length track 1302 and a safety rail system 1304, according to an example of the principles described herein. FIG. 14 is a schematic of the expandable lift system 100 of FIG. 13 depicting a first close-up view of the full-length track 1302 and a safety rail system 1304, according to an example of the principles described herein. FIG. 15 is a schematic of the expandable lift system 100 of FIG. 13 depicting a second close-up view of the full-length track 1302 and a safety rail system 1304, according to an example of the principles described herein. FIG. 16 is a schematic of the expandable lift system 100 of FIG. 13 depicting a first close-up view of the full-length track 1302 and a safety rail system 1304, according to an example of the principles described herein.

As depicted in FIGS. 13 through 16, a first full-length track 1302-1 may be coupled to the first stationary stanchion 106-1 and the first translatable stanchion 108-1. Further, a second full-length track 1302-2 may be coupled to the second stationary stanchion 106-2 and the second translatable stanchion 108-2. The first full-length track 1302-1 and the second full-length track 1302-2 are collectively referred to herein as full-length track(s) 1302 unless specifically addressed otherwise. The translatable stanchions 108 are slidingly engaged with the full-length track(s) 1302 such that the translatable stanchions 108 may be pulled or pushed along the full-length track(s) 1302 in the directions of arrow 136 to expand or contract the width (w) of the expandable lift system 100. In the examples described herein, as the translatable stanchions 108 are moved along the full-length track(s) 1302, the panels 104 of the platform 102 may be added or removed to increase or decrease the surface size of the platform 102. For example, in instances where the user seeks to decrease the width (w) of the expandable lift system 100, one or more panels 104 may be removed from the platform 102 to allow the translatable stanchions 108 to be moved along the full-length track(s) 1302 toward the stationary stanchions 106. Conversely, in instances where the user seeks to increase the width (w) of the expandable lift system 100, one or more panels may be coupled to the platform 102 in order to provide a platform 102 having a larger surface area. In this manner, the full-length track(s) 1302 and the translatable stanchions 108 provide for vehicles and other objects of varying sizes to be hoisted onto the expandable lift system 100.

Further, the full-length track(s) 1302 allow for all the panels 104 of the platform 102 to be removed from the platform 102. In this example, a near entirely of the width (w) of the platform 102 may be reduced to a width of the stationary stanchions 106 and translatable stanchions 108. Thus, in instances where the expandable lift system 100 is not being used, the user may contract the width (w) of the platform 102 to allow for more area next to the expandable lift system 100 to be used for other purposes such as parking a vehicle. As similarly described herein in connection with tracks 118, the full-length track(s) 1302 are engineered to be strong enough and are shaped and have a profile low enough to allow vehicles to run over the full-length track(s) 1302 without damaging the full-length track(s) 1302 or the vehicle. In this manner, the utility of the expandable lift system 100 may be installed while still allowing for a conservation of a space in which the expandable lift system 100 is installed. This may prove to be effective in situations where the user has installed the expandable lift system 100 in a personal and/or residential garage or other location where space may be limited or may require versatility. The interface between the full-length track(s) 1302 and the stationary stanchions 106 and translatable stanchions 108 are described in more detail herein. In one example, in order to contract the size of the platform 102 such that all panels 104 are removed from the platform 102 and the stationary stanchions 106 are located next to or abut the translatable stanchions 108, a number of the supports 126 may be removed to allow such a contraction.

In one example, the stationary stanchions 106, the translatable stanchions 108, and/or the full-length track(s) 1302 may or may not be coupled to the substructure 134. In connection with the caster devices 1100 described above in relation to FIGS. 11 and 12, the caster devices 1100-1, 1100-2, 1100-3, 1100-4 (collectively referred to herein as caster device(s) 1100 unless specifically addressed otherwise), may be utilized to move the expandable lift system 100 in instances where the stationary stanchions 106, the translatable stanchions 108, and/or the full-length track(s) 1302 are not coupled to the substructure 134. Further, in one example the stationary stanchions 106 and/or the full-length track(s) 1302 are coupled to the substructure 134.

Still further, in one example, the stationary stanchions 106, the translatable stanchions 108, and/or the full-length track(s) 1302 are non-permanently coupled to the substructure 134. In this example, a number of fasteners may be extended through apertures defined in the bases 122, bottom plates 804, or other elements of the stationary stanchions 106 and/or the translatable stanchions 108 and/or apertures defined in the full-length track(s) 1302. The fasteners may couple the stationary stanchions 106, the translatable stanchions 108, and/or the full-length track(s) 1302 to the substructure 134 and may be decoupled from the substructure 134 when a user desires to move the expandable lift system 100 from one position to another. In one example, the horizontal braces 702 and/or diagonal braces 704 may be removed before contracting the platform 102 via the full-length track(s) 1302. Conversely, to provide stability to the expandable lift system 100, the horizontal braces 702 and/or diagonal braces 704 may be installed as depicted in, for example FIGS. 7, and 11-16.

The expandable lift system 100 may further include the safety rail system 1304. Because a user may be hoisted by the expandable lift system 100, the safety rail system 1304 serves to ensure that the user does not fall from a height once hoisted. The safety rail system 1304 may include a number of posts 1310-1, 1310-2, 1310-3, 1310-4 (collectively referred to herein as post(s) 1310 unless specifically addressed otherwise) positioned at the four corners of the platform 102. Although four posts 1310 are depicted in FIGS. 13 through 16, any number of posts may be included in the expandable lift system 100. The four posts 1310 are coupled to the stanchions 106, 108 by being inserted into a corresponding number of post brackets 1306-1, 1306-2, 1306-3, 1306-4 (collectively referred to herein as post bracket(s) 1306 unless specifically addressed otherwise). The post brackets 1306 may be welded, formed on, or otherwise coupled to the side rails 116-1, 116-2.

A number of top chains 1312-1, 1312-2, 1312-3, 1312-4 (collectively referred to herein as top chain(s) 1312 unless specifically addressed otherwise) and a number of bottom chains 1314-1, 1314-2, 1314-3, 1314-4 (collectively referred to herein as bottom chain(s) 1314 unless specifically addressed otherwise) may be coupled to the posts 1310 to serve as railings that retain a user on the platform 102. In one example, the top chains 1312 and the bottom chains 1314 may be coupled to the posts 1310 via a number of eyebolts fastened or welded to the posts 1310. Further, a number of fasteners may be coupled to the top chains 1312 and the bottom chains 1314 such as bolt snaps, carabiners, lobster clasps, shackles, and other fasteners that may serve to couple the top chains 1312 and the bottom chains 1314 to the posts 1310.

When in use, the top chains 1312, bottom chains 1314, and posts 1310 may be coupled to the expandable lift system 100 as depicted in FIGS. 13 through 16 and described herein. However, when the top chains 1312, bottom chains 1314, and posts 1310 are not in use, they may be stored in a corresponding number of post storage brackets 1308-1, 1308-2, 1308-3, 1308-4 (collectively referred to herein as post storage bracket(s) 1308 unless specifically addressed otherwise). The post storage brackets 1308 may be welded, formed on, or otherwise coupled to the stationary stanchions 106 and/or the translatable stanchions 108. The top chains 1312 and the bottom chains 1314 may be decoupled from the posts 1310 and placed in the post storage brackets 1308 for storage. The both ends of a given top chain 1312 and/or bottom chains 1314 may be coupled to a corresponding post to store the top chains 1312 and/or bottom chains 1314 along with the posts 1310. In this manner, the top chains 1312 and/or bottom chains 1314 may be stored by hanging ends of the same chain from a single post 1310.

In one example, the top chains 1312 and the bottom chains 1314 may have a length equal to or greater than a maximum width of the platform 102 of the expandable lift system 100. This allows for the top chains 1312 and the bottom chains 1314 to be coupled at a shorter length as the width of the platform 102 is adjusted. This allows for the chains to continue to be utilized at any width of the platform 102, resulting in the ability to increase the safety of a user when the user is occupying the platform 102 during a lifting of the expandable lift system 100.

Figure 17:
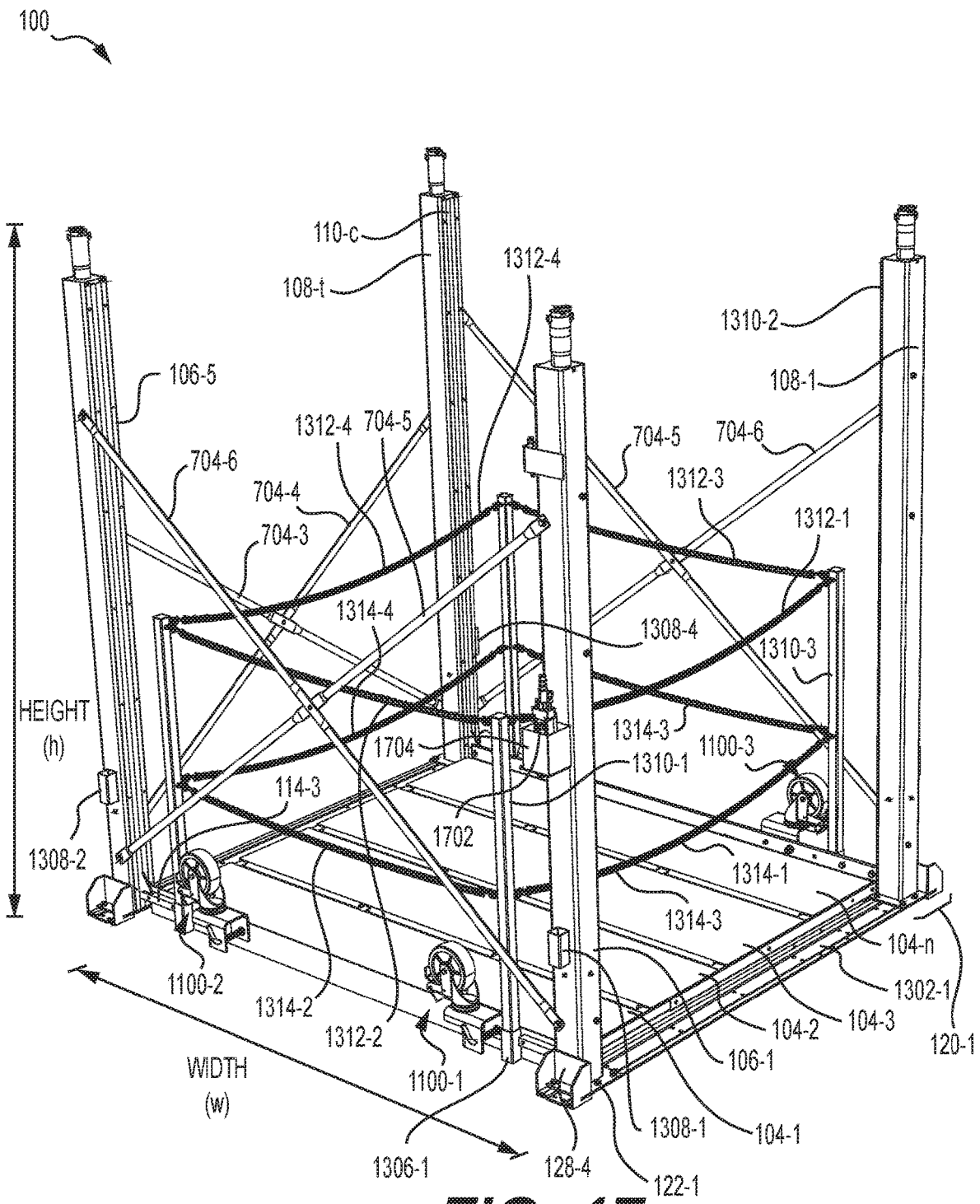
FIG. 17 is a schematic of an expandable lift system 100 depicting a mobile control interface 1702, according to an example of the principles described herein.
Figure 18:
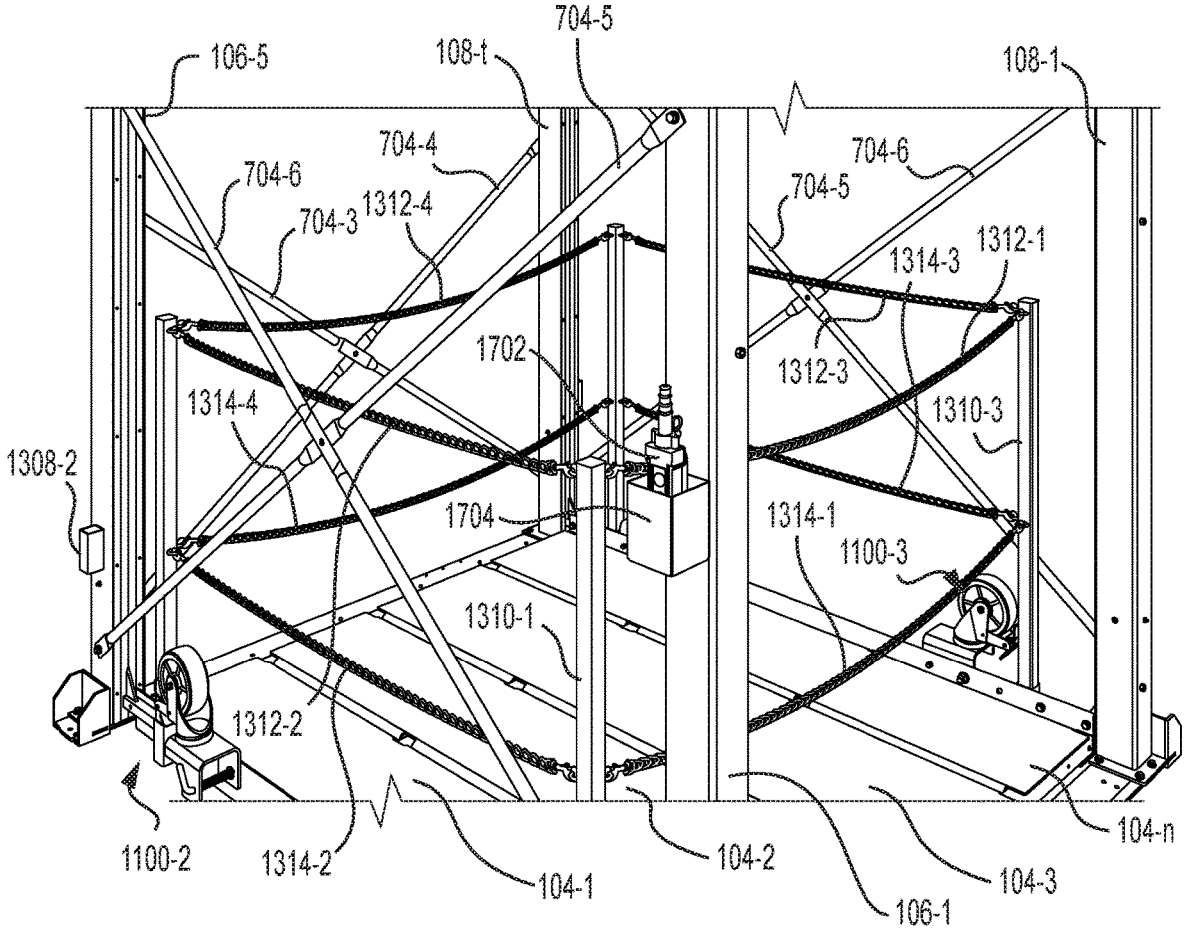
FIG. 18 is a schematic of the expandable lift system of FIG. 17 depicting the mobile control interface, according to an example of the principles described herein.

FIG. 17 is a schematic of an expandable lift system 100 depicting a mobile control interface 1702, according to an example of the principles described herein. FIG. 18 is a schematic of the expandable lift system 100 of FIG. 17 depicting the mobile control interface 1702, according to an example of the principles described herein. As indicated above, a user may access the platform 102 in order to, for example use the expandable lift system 100 to lift the user to a higher height. The control interface 1002 of, for example, FIG. 10 may be difficult to reach for the user as the control interface 1002 may be located beyond the reach of the user as the user stands on the platform 102. Thus, in the example of FIGS. 17 and 18, a mobile control interface 1702 may be provided.

The mobile control interface 1702 may be communicatively coupled to the stepper motors 124 via a wired or a wireless communication path. In an example where the communication path between the stepper motors 124 and the mobile control interface 1702 is a wired communication path, the wire may send signals from the mobile control interface 1702 to the stepper motors 124 to actuate the stepper motors 124. The wire may extend far enough to allow the user to hold the mobile control interface 1702 in their hand and access the controls of the mobile control interface 1702 in order to operate the expandable lift system 100.

In an example where the communication path between the stepper motors 124 and the mobile control interface 1702 is a wireless communication path, signals may be sent from the mobile control interface 1702 to the stepper motors 124 to actuate the stepper motors 124 via a wireless communication protocol. The wireless communication protocol may include, for example, Institute of Electrical and Electronics Engineers (IEEE) 802.11 family of standards commonly referred to as Wi-Fi®, industrial, scientific and medical (ISM) telecommunications standards such as Bluetooth®, and cellular network communications standards such as Long-Term Evolution (LTE) wireless broadband communication standards, among other wireless communication standards.

In one example, the mobile control interface 1702 may be stored within a receptacle 1704. The receptacle 1704 may be coupled to one of the stanchions 106, 108 so that the mobile control interface 1702 may be stowed along with the expandable lift system 100.

The user may be lifted by the expandable lift system 100 by accessing and holding the mobile control interface 1702, access the platform 102, and use the mobile control interface 1702 to lift the platform 102. As the platform 102 rises, the user can retain the mobile control interface 1702 in their possession while continuing to raise and lower the platform 102. The example of FIGS. 16 and 17 provide a safe option to the user compared to the user attempting to reach the control interface 1002 of FIG. 10 that is coupled to one of the stanchions 106, 108.

Examples described herein provide a system including a platform. The platform includes a first portion and a second portion expandable relative to the first portion. A first lifting assembly is disposed within a first stationary stanchion. The first lifting assembly includes a first threaded screw rotatably disposed within the first stationary stanchion, and a first body disposed within the first stationary stanchion, threadingly coupled to the first threaded screw, and coupled to a first corner of the platform located on the first portion. A second lifting assembly disposed within a second stationary stanchion includes a second threaded screw rotatably disposed within the second stationary stanchion, and a second body disposed within the second stationary stanchion, threadingly coupled to the second threaded screw, and coupled to a second corner of the platform located on the first portion. A third lifting assembly is disposed within a first translatable stanchion. The third lifting assembly includes a third threaded screw rotatably disposed\within the first translatable stanchion and a third body disposed within the first translatable stanchion. The third body is threadingly coupled to the third threaded screw and coupled to a third corner of the platform located on the second portion. A fourth lifting assembly is disposed within a second translatable stanchion. The fourth lifting assembly includes a fourth threaded screw rotatably disposed within the second translatable stanchion and a fourth body disposed within the second translatable stanchion. The fourth body is threadingly coupled to the fourth threaded screw and coupled to a fourth corner of the platform located on the second portion.

The system further includes a first track coupled to the first translatable stanchion, the first translatable stanchion translatably engaged with the first track to allow the first translatable stanchion to move laterally in a first direction, and a second track coupled to the second translatable stanchion, the second translatable stanchion translatably engaged with the second track to allow the second translatable stanchion to move laterally in the first direction. The second portion of the platform expands relative to the first portion in the first direction when the first translatable stanchion and the second translatable stanchion move in the first direction.

The system further includes a first motor coupled to the first threaded screw. The first motor rotates the first threaded screw. The system further includes a second motor coupled to the second threaded screw. The second motor rotates the second threaded screw. The system further includes a third motor coupled to the third threaded screw. The third motor rotates the third threaded screw. The system further includes a fourth motor coupled to the fourth threaded screw. The fourth motor rotates the fourth threaded screw.

The system further includes a control system to control activation of the first motor, the second motor, the third motor, and the fourth motor. The control system includes a control interface and control logic communicatively coupled to the control interface. The control logic activates the first motor, the second motor, the third motor, and the fourth motor to rotate the first threaded screw, the second threaded screw, the third threaded screw, and the fourth threaded screw at a synchronized rate.

The system further includes a position sensor to sense a position of the platform along a length of a height of the first stationary stanchion, the second stationary stanchion, the first translatable stanchion, and the second translatable stanchion. The operations further include detecting, with the position sensor, the position of the platform, and deactivating the first motor, the second motor, the third motor, and the fourth motor in response to a determination that the platform has been vertically lifted to a predetermined height.

The first stationary stanchion and the second stationary stanchion are coupled to a substructure. Further, the first track and the second track are coupled to the substructure. The system further includes at least one support coupled between the first lifting assembly, the second lifting assembly, the third lifting assembly, and the fourth lifting assembly. The second portion of the platform includes at least one detachable panel to expand a dimension of the platform when the second portion is expanded relative to the first portion.

Examples described herein also provide a lift. The lift includes a platform. The platform includes a first portion, and a second portion expandable relative to the first portion. The platform also includes a first screw jack coupled to a first corner of the platform located on the first portion, a second screw jack coupled to a second corner of the platform located on the first portion, a third screw jack coupled to a third corner of the platform located on the second portion, and a fourth screw jack coupled to a fourth corner of the platform located on the second portion. The platform also includes a first motor coupled to the first screw jack. The first motor rotates the first screw jack. The platform also includes a second motor coupled to the second screw jack. The second motor to rotate the second screw jack. The platform also includes a third motor coupled to the third screw jack. The third motor to rotate the third screw jack. The platform also includes a fourth motor coupled to the fourth screw jack. The fourth motor to rotate the fourth screw jack. The platform also includes a control system to control activation of the first motor, the second motor, the third motor, and the fourth motor. The control system includes a user interface to control vertical translation of the platform based on activation of the first motor, the second motor, the third motor, and the fourth motor. Further, the platform also includes control logic communicatively coupled to the user interface to perform operations including activating the first motor, the second motor, the third motor, and the fourth motor to vertically translate the platform based on user-input at the user interface. The control logic synchronizes the first motor, the second motor, the third motor, and the fourth motor to cause the first screw jack, the second screw jack, the third screw jack, and the fourth screw jack to rotate at a same rate.

In one example, the lift further includes a position sensor to sense a position of the platform along a length of a height of the first screw jack, the second screw jack, the third screw jack, and the fourth screw jack. The operations further include detecting, with the position sensor, the position of the platform, and deactivating the first motor, the second motor, the third motor, and the fourth motor in response to a determination that the platform has been vertically lifted to a predetermined height.

The first screw jack is housed within a first stanchion, the second screw jack is housed within a second stanchion, the third screw jack is housed within a third stanchion, and the fourth screw jack is housed within a fourth stanchion. The lift further includes a first track coupled to the third stanchion. The third stanchion translatably engages with the first track to allow the third stanchion to move laterally in a first direction. The lift further includes a second track coupled to the fourth stanchion. The fourth stanchion translatably engages with the second track to allow the fourth stanchion to move laterally in the first direction. The second portion of the platform expands relative to the first portion in the first direction when the third stanchion and the fourth stanchion move in the first direction.

The first stanchion and the second stanchion are coupled to a substructure, and the first track and the second track are coupled to the substructure. The lift further includes at least one support coupled between the first stanchion, the second stanchion, the third stanchion, and the fourth stanchion. The platform further includes a textured surface. The lift further includes at least one sensor to detect a degree of levelness of the platform.

Examples described herein also provide an expandable lift system. The expandable lift system includes an expandable platform including at least one detachable panel to expand a dimension of the expandable platform, at least one stationary stanchion housing a first lifting assembly, the first lifting assembly being coupled to a first side of the expandable platform, at least one translatable stanchion housing a second lifting assembly, the second lifting assembly coupled to a second side of the platform, at least one track coupled to a substructure on which the lift sits. The track includes a rail defined within the at least one track, the at least one translatable stanchion configured to translatably engage the rail to allow the at least one translatable stanchion to move laterally in a first direction, and at least one stop located at at least one end of the track to retain engagement of the at least one translatable stanchion within the rail.

The first lifting assembly includes a first body disposed within the at least one stationary stanchion, and a first screw jack threadingly coupled to the first body. The second lifting assembly includes a second body disposed within the at least one translatable stanchion, and a second screw jack threadingly coupled to the second body.

The expandable lift system further includes a first motor coupled to the first lifting assembly, the first motor to activate the first lifting assembly, and a second motor coupled to the second lifting assembly, the second motor to activate the second lifting assembly. The expandable lift system further includes a control system to control activation of the first motor and the second motor. The control system includes a control interface, and control logic communicatively coupled to the control interface to activate the first motor and the second motor such that revolutions per minute (RPM) of the first motor and the second motor are synchronized. The operations further include detecting, with at least one sensor, a height of the expandable platform, in response to the platform being at a predetermined height, deactivating the first motor and the second motor.

INDUSTRIAL APPLICABILITY

The present disclosure describes systems and methods for an expandable lift system includes an expandable platform including at least one detachable panel to expand a dimension of the expandable platform, at least one stationary stanchion housing a first lifting assembly, the first lifting assembly being coupled to a first side of the expandable platform, at least one translatable stanchion housing a second lifting assembly, the second lifting assembly coupled to a second side of the platform, at least one track coupled to a substructure on which the lift sits. The track includes a rail defined within the at least one track, the at least one translatable stanchion configured to translatably engage the rail to allow the at least one translatable stanchion to move laterally in a first direction, and at least one stop located at at least one end of the track to retain engagement of the at least one translatable stanchion within the rail.

Such systems and methods may be used to more safely and efficiently lift objects to a desired height. Further, the addition of an expandable platform allows for the lift to be expanded and contracted based on a desired need for space. This allows for the expandable lift to be installed in an area with a relatively smaller footprint as compared to other lift systems due to the expandable features of the expandable lift system.

While aspects of the present disclosure have been particularly shown and described with reference to the examples above, it will be understood by those skilled in the art that various additional examples may be contemplated by the modification of the disclosed machines, systems, and methods without departing from the spirit and scope of what is disclosed. Such examples should be understood to fall within the scope of the present disclosure as determined based upon the claims and any equivalents thereof.

What is claimed is:

1. A lifting system comprising:

a platform including:

a first portion, and a second portion expandable relative to the first portion;

a first lifting assembly disposed within a first stationary stanchion, including:

a first threaded screw rotatably disposed within the first stationary stanchion, and a first body disposed within the first stationary stanchion threadingly coupled to the first threaded screw, and coupled to a first corner of the platform located on the first portion;

a second lifting assembly disposed within a second stationary stanchion, including:

a second threaded screw rotatably disposed within the second stationary stanchion, and a second body disposed within the second stationary stanchion threadingly coupled to the second threaded screw, and coupled to a second corner of the platform located on the first portion;

a third lifting assembly disposed within a first translatable stanchion, including:

a third threaded screw rotatably disposed within the first translatable stanchion, and a third body disposed within the first translatable stanchion threadingly coupled to the third threaded screw, and coupled to a third corner of the platform located on the second portion;

a fourth lifting assembly disposed within a second translatable stanchion, including:

a fourth threaded screw rotatably disposed within the second translatable stanchion, and a fourth body disposed within the second translatable stanchion threadingly coupled to the fourth threaded screw, and coupled to a fourth corner of the platform located on the second portion;

a first track coupled to the first translatable stanchion, the first translatable stanchion translatably engaged with the first track via a first track guide coupled to the first translatable stanchion and wrapped around a bottom edge of the first track to allow the first translatable stanchion to move laterally in a direction; and a second track coupled to the second translatable stanchion, the second translatable stanchion translatably engaged with the second track via a second track guide coupled to the second translatable stanchion and wrapped around a bottom edge of the second track to allow the second translatable stanchion to move laterally in the direction, wherein the second portion of the platform expands relative to the first portion in the direction when the first translatable stanchion and the second translatable stanchion move in the direction, and wherein the first track and the second track are coupled to a substructure below the lifting system.

2. The lifting system of claim 1, further comprising:

a first motor coupled to the first threaded screw, the first motor to rotate the first threaded screw;

a second motor coupled to the second threaded screw, the second motor to rotate the second threaded screw;

a third motor coupled to the third threaded screw, the third motor to rotate the third threaded screw;

a fourth motor coupled to the fourth threaded screw, the fourth motor to rotate the fourth threaded screw; and a control system to control activation of the first motor, the second motor, the third motor, and the fourth motor, the control system including:

a control interface, and control logic communicatively coupled to the control interface to:

activate the first motor, the second motor, the third motor, and the fourth motor to rotate the first threaded screw, the second threaded screw, the third threaded screw, and the fourth threaded screw at a synchronized rate.

3. The lifting system of claim 2, further comprising:

a position sensor to sense a position of the platform along a length of a height of the first stationary stanchion, the second stationary stanchion, the first translatable stanchion, and the second translatable stanchion, wherein the control logic:

detects, with the position sensor, the position of the platform; and deactivates the first motor, the second motor, the third motor, and the fourth motor in response to a determination that the platform has been vertically lifted to a predetermined height.

4. The lifting system of claim 2, further comprising:

a first encoder communicatively coupled to the first motor;

a second encoder communicatively coupled to the second motor;

a third encoder communicatively coupled to the third motor; and a fourth encoder communicatively coupled to the fourth motor;

wherein the first encoder, the second encoder, the third encoder, and the fourth encoder are configured to determine a position of the platform based on a detected rotated position of a shaft of the first motor, second motor, third motor, and fourth motor, respectively.

5. The lifting system of claim 1, wherein the first stationary stanchion and the second stationary stanchion are coupled to the substructure.

6. The lifting system of claim 1, further comprising at least one support coupled between the first lifting assembly, the second lifting assembly, the third lifting assembly, and the fourth lifting assembly.

7. The lifting system of claim 1, wherein the second portion of the platform includes at least one detachable panel to expand a dimension of the platform when the second portion is expanded relative to the first portion.

8. The lifting system of claim 1, wherein:

the first body includes an engineering fit with respect to the first stationary stanchion to allow the first body to move within the first stationary stanchion, the second body includes the engineering fit with respect to the second stationary stanchion to allow the second body to move within the second stationary stanchion, the third body includes the engineering fit with respect to the first translatable stanchion to allow the third body to move within the first translatable stanchion, and the fourth body includes the engineering fit with respect to the second translatable stanchion to allow the fourth body to move within the second translatable stanchion.

9. A lift comprising:

a platform including:

a first portion, and a second portion expandable relative to the first portion;

a first screw jack coupled to a first corner of the platform located on the first portion;

a second screw jack coupled to a second corner of the platform located on the first portion;

a third screw jack coupled to a third corner of the platform located on the second portion;

a fourth screw jack coupled to a fourth corner of the platform located on the second portion;

a first motor coupled to the first screw jack and housed in a first stanchion, the first motor to rotate the first screw jack;

a second motor coupled to the second screw jack and housed in a second stanchion, the second motor to rotate the second screw jack;

a third motor coupled to the third screw jack and housed in a third stanchion, the third motor to rotate the third screw jack;

a fourth motor coupled to the fourth screw jack and housed in a fourth stanchion, the fourth motor to rotate the fourth screw jack;

a first track coupled to the third stanchion, the third stanchion translatably engaged with the first track via a first track guide coupled to the third stanchion and wrapped around a bottom edge of the first track to allow the third stanchion to move laterally in a direction;

a second track coupled to the fourth stanchion, the fourth stanchion translatably engaged with the second track via a second track guide coupled to the fourth stanchion and wrapped around a bottom edge of the second track to allow the fourth stanchion to move laterally in the direction; and a control system to control activation of the first motor, the second motor, the third motor, and the fourth motor, the control system including:

a user interface to control vertical translation of the platform based on activation of the first motor, the second motor, the third motor, and the fourth motor; and control logic communicatively coupled to the user interface to perform operations comprising:

activating the first motor, the second motor, the third motor, and the fourth motor to vertically translate the platform based on user-input at the user interface, wherein the control logic is communicatively coupled to the first motor, the second motor, the third motor, and the fourth motor to cause the first screw jack, the second screw jack, the third screw jack, and the fourth screw jack to synchronously rotate at a same rate the first track and the second track are coupled to a substructure below the lift.

10. The lift of claim 9, further comprising:

a position sensor to sense a position of the platform along a length of a height of the first screw jack, the second screw jack, the third screw jack, and the fourth screw jack, wherein the operations further comprise:

detecting, with the position sensor, the position of the platform; and deactivating the first motor, the second motor, the third motor, and the fourth motor in response to a determination that the platform has been vertically lifted to a predetermined height.

11. The lift of claim 9, wherein:

the first screw jack is housed within the first stanchion, the second screw jack is housed within the second stanchion, the third screw jack is housed within the third stanchion, the fourth screw jack is housed within the fourth stanchion, wherein the second portion of the platform expands relative to the first portion in a direction when the third stanchion and the fourth stanchion move in the direction.

12. The lift of claim 11, wherein:

the first stanchion and the second stanchion are coupled to the substructure.

13. The lift of claim 11, further comprising at least one support coupled between the first stanchion, the second stanchion, the third stanchion, and the fourth stanchion.

14. The lift of claim 11, wherein the platform further includes a textured surface.

15. The lift of claim 11, further comprising at least one sensor to detect a degree of levelness of the platform.

16. The lift of claim 9 wherein the platform includes:

at least one side rail to couple the first portion and the second portion;

at least one arm coupled to the side rail, a jack mount coupled to the arm; and a jack mount base coupled to the jack mount and threadingly coupled to a screw drive of at least one of the first screw jack, the second screw jack, the third screw jack, and the fourth screw jack.

17. An expandable lift system, comprising:

an expandable platform including at least one detachable panel to expand a dimension of the expandable platform;

at least one stationary stanchion housing a first lifting assembly, the first lifting assembly being coupled to a first side of the expandable platform;

at least one translatable stanchion housing a second lifting assembly, the second lifting assembly coupled to a second side of the expandable platform;

at least one track coupled to a substructure on which the expandable lift system sits, the track including:

a rail defined within the at least one track, the at least one translatable stanchion configured to translatably engage the rail via a track guide coupled to the at least one translatable stanchion and wrapped around a bottom edge of the rail to allow the at least one translatable stanchion to move laterally in a first direction; and at least one stop located at least one end of the track to retain engagement of the at least one translatable stanchion within the rail.

18. The expandable lift system of claim 17, further comprising:

a first motor coupled to the first lifting assembly, the first motor to activate the first lifting assembly; and a second motor coupled to the second lifting assembly, the second motor to activate the second lifting assembly.

19. The expandable lift system of claim 18, further comprising:

a control system to control activation of the first motor and the second motor, the control system including:

a control interface; and control logic communicatively coupled to the control interface to activate the first motor and the second motor such that revolutions per minute (RPM) of the first motor and the second motor are synchronized.

20. The expandable lift system of claim 19, wherein the control logic further:

detects, with at least one sensor, a height of the expandable platform; and in response to the platform being at a predetermined height, deactivates the first motor and the second motor.

* * * * *